US012486604B2

(12) United States Patent
Yun et al.

(10) Patent No.: US 12,486,604 B2
(45) Date of Patent: Dec. 2, 2025

(54) CLOTHING TREATMENT APPARATUS

(71) Applicant: LG Electronics Inc., Seoul (KR)

(72) Inventors: Sungjun Yun, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 72 days.

(21) Appl. No.: 18/686,286

(22) PCT Filed: Aug. 22, 2022

(86) PCT No.: PCT/KR2022/012474
§ 371 (c)(1),
(2) Date: Feb. 23, 2024

(87) PCT Pub. No.: WO2023/027440
PCT Pub. Date: Mar. 2, 2023

(65) Prior Publication Data

US 2024/0426037 A1 Dec. 26, 2024

(30) Foreign Application Priority Data

Aug. 25, 2021 (KR) ..... 10-2021-0112239

(51) Int. Cl.
*D06F 33/37* (2020.01)
*D06F 33/34* (2020.01)
(Continued)

(52) U.S. Cl.
CPC ..... *D06F 33/37* (2020.02); *D06F 33/34* (2020.02); *D06F 34/28* (2020.02); *D06F 2105/42* (2020.02)

(58) Field of Classification Search
CPC ..... D06F 33/37
See application file for complete search history.

(56) References Cited

U.S. PATENT DOCUMENTS

| | | | |
|---|---|---|---|
| 7,921,493 | B2 | 4/2011 | Kim et al. |
| 2016/0069012 | A1 | 3/2016 | Kim et al. |
| 2017/0159221 | A1 | 6/2017 | Cho et al. |

FOREIGN PATENT DOCUMENTS

| | | |
|---|---|---|
| CN | 103343436 A | 10/2013 |
| JP | 2020-065741 | 4/2020 |

(Continued)

OTHER PUBLICATIONS

International Search Report and Written Opinion in International Appln. No. PCT/KR2022/012474, mailed on Dec. 5, 2022, 20 pages (with English translation).

(Continued)

*Primary Examiner* — Jason Y Ko
(74) *Attorney, Agent, or Firm* — Fish & Richardson P.C.

(57) ABSTRACT

A clothing treatment apparatus includes: a cabinet; a tub provided inside the cabinet; a drum rotatably provided inside the tub and accommodating laundry therein; a detergent supplier coupled to the tub and supplying detergent to the tub by driving a detergent pump connected to a first detergent container and a second detergent container in which detergent is stored; and a controller that, when the detergent stored in the first detergent container or the second detergent container corresponds to a scheduled detergent change state in which the detergent is scheduled to be changed to a different type of detergent, drives the detergent pump to perform a residual detergent discharge process, corresponding to the scheduled detergent change state, of discharging residual detergent from the first detergent container or the second detergent container.

20 Claims, 16 Drawing Sheets

(51) Int. Cl.
*D06F 34/28* (2020.01)
*D06F 105/42* (2020.01)

(56) References Cited

FOREIGN PATENT DOCUMENTS

| | | |
|---|---|---|
| JP | 2020-523158 | 8/2020 |
| KR | 10-1500881 | 3/2015 |
| KR | 10-2233307 | 11/2015 |
| WO | 2021/023113 A1 | 2/2021 |

OTHER PUBLICATIONS

Extended European Search Report in European Appln. No. 22861650.
4, mailed on Jul. 22, 2025, 9 pages.

CLOTHING TREATMENT APPARATUS

CROSS-REFERENCE TO RELATED APPLICATIONS

This application is a National Stage application under 35 U.S.C. § 371 of International Application No. PCT/KR2022/012474, filed on Aug. 22, 2022, which claims the benefit of Korean Application No. 10-2021-0112239, filed on Aug. 25, 2021. The disclosures of the prior applications are incorporated by reference in their entirety.

TECHNICAL FIELD

The present disclosure relates to an apparatus for treating laundry, and more particularly, to a laundry treating apparatus having a detergent supplier.

BACKGROUND ART

A laundry treating apparatus is an apparatus that performs various treatment processes on laundry, such as washing or drying laundry, and includes a washing machine, a dryer, a refresher (e.g., a styler), and the like.

The laundry treating apparatus may be classified into a top loading type or a front loading type based on a type of putting laundry into a drum, and may include a cabinet forming an appearance of the laundry treating apparatus.

A washing machine capable of performing a washing cycle of laundry may remove contamination on the laundry by putting laundry such as clothes, linen, and the like into a drum. The washing cycle of the laundry may include a wash process, a rinse process, a spin process, a dry process, and the like.

The laundry treating apparatus capable of performing washing of laundry may include a tub accommodated in the cabinet, a drum rotatably mounted in the tub and accommodating laundry therein, and a detergent supplier supplying detergent into the tub.

When the drum is rotated by a motor or the like while washing water is supplied to the laundry accommodated in the drum, contaminants and filth attached to the laundry may be removed by friction with the drum and the washing water.

The detergent supplier is equipped with a detergent supply function to enhance a washing effect. Here, the detergent refers to a material that enhances a washing effect such as a fiber detergent, a fabric softener, a fiber bleaching agent, etc. A powder type detergent, a liquid type detergent and the like may be used as the detergent.

Meanwhile, a detergent supplier included in a laundry treating apparatus is disclosed in the Korean Laid-open Gazette No. KR 10-2018-0090003 A1. The laundry treating apparatus may perform washing on laundry by providing a detergent stored in the detergent supplier into a tub to wash the laundry.

The detergent supplier may include a plurality of detergent containers in which detergents are stored, and a user may execute the washing of the laundry by arbitrarily storing various detergents in a plurality of the detergent containers, respectively.

Accordingly, the washing cycle of the laundry may be performed by using various detergents stored in a plurality of the detergent containers in an effective manner, and furthermore, maintenance of the detergent container in which various detergents are stored may become a significant technical task in the present technical field.

DISCLOSURE

Technical Tasks

One technical task of the present application is to provide a laundry treating apparatus capable of preventing a coagulation phenomenon of a detergent when the use of a detergent container capable of storing various kinds of detergents is changed.

Another technical task of the present disclosure is to provide a laundry treating apparatus capable of washing a detergent container when the type of a detergent stored in a detergent container is changed.

Another technical task of the present application is to provide a laundry treating apparatus capable of preventing a detergent to be changed from being mixed with a previously stored detergent when the type of a detergent stored in a detergent container is changed.

Further technical task of the present disclosure is to provide a laundry treating apparatus capable of washing a flow path connected to a detergent container when the type of a detergent stored in a detergent container is changed.

Another further technical task of the present disclosure is to provide a laundry treating apparatus enabling a user to select whether to wash a detergent container after checking whether the detergent container needs to be washed.

Technical Solutions

In order to solve the above-described problems, an apparatus for treating laundry according to one embodiment of the present disclosure may perform a residual detergent discharge step in which a controller controls a detergent pump to discharge a residual detergent of a first detergent container or a second detergent container related to a detergent change scheduled state based on a case related to the detergent change schedule state for scheduling a detergent stored in the first detergent container or the second detergent container to be changed to a different type detergent.

An apparatus for treating laundry according to one embodiment of the present disclosure may include a cabinet, a tub provided in the cabinet and accommodating water therein, a drum rotatably provided in the tub and accommodating the laundry therein, a detergent supplier connected to the tub and configured to drive a detergent pump connected to first and second detergent containers storing a detergent to supply the detergent to the tub, and a controller performing a residual detergent discharge step of based on a case related to a detergent change scheduled state for scheduling the detergent stored in the first detergent container or the second detergent container to be changed to a different type detergent, discharging a residual detergent of the first or second detergent container related to the detergent change scheduled state by driving the detergent pump.

The controller may determine whether to be related to the detergent change scheduled state based on a manipulation signal inputted by a user through a manipulation unit provided to the cabinet or a communication terminal carried by the user.

The detergent pump may include a first detergent pump connected to the first detergent container and a second detergent pump connected to the second detergent container, and the controller may independently control the first detergent pump and the second detergent pump to perform a residual detergent discharge step of each of the first detergent container and the second detergent container.

The detergent may include at least one of a washing agent for removing contaminants from the laundry or a softener for ensuring flexibility of the laundry, and the controller may determine that the detergent stored in each of the first detergent container and the second detergent container is related to the detergent change scheduled state when the detergent stored in each of the first detergent container or the second detergent container is scheduled to be changed between the washing agent and the softener.

The controller may control the detergent supplier to selectively perform one of a single detergent mode of supplying the washing agent to the tub from one of the first detergent container and the second detergent container, a composite detergent mode of supplying the washing agent to the tub from each of the first detergent container and the second detergent container, and a softener mode of supplying the washing agent to the tub from one of the first detergent container and the second detergent container and supplying the softener from the other to the tub.

The controller may perform any one of the single detergent mode, the composite detergent mode, and the softener mode based on a manipulation signal inputted by a user through a manipulation unit provided to the cabinet or a communication terminal carried by the user.

The controller may determine to be related to the detergent change scheduled state based on performing the softener mode after performing the single detergent mode or the composite detergent mode or performing the single detergent mode or the composite detergent mode after performing the softener mode.

The controller may determine to be related to the detergent change scheduled state based on inputting a manipulation signal of changing the detergent stored in each of the first detergent container and the second detergent container from the washing agent to the softener or a manipulation signal of changing the detergent from the softener to the washing agent through a manipulation unit provided to the cabinet or a communication terminal carried by a user.

The controller may perform a washing request step of requesting a user to select whether to progress the residual detergent discharge step through a notification unit provided to the cabinet or a communication terminal carried by the user based on being related to the detergent change scheduled state.

The controller may perform a water supply request step of requesting to supply water to the first detergent container or the second detergent container through the notification unit or the communication terminal based on determining to progress the residual detergent discharge step in the washing request step.

The apparatus may further include a residual amount sensing unit sensing a water level of the first detergent container or the second detergent container, and the controller may perform a water supply check step of determining whether the water is supplied to the first detergent container or the second detergent container in response to the water supply request step based on a measurement value of the residual amount sensing unit.

The controller may perform the residual detergent discharge step based on determining that the water is supplied to the first detergent container or the second detergent container in the water supply check step.

Based on completing the residual detergent discharge step, the controller may request a user to supply the detergent to the first detergent container or the second detergent container having completed the residual detergent discharge step through a notification unit provided to the cabinet or a communication terminal carried by the user.

The controller may control the detergent pump to be operated for a preset time in the residual detergent discharge step and may control the water supply unit to supply the water to the tub in the residual detergent discharge step.

Advantageous Effects

The present application may provide a laundry treating apparatus capable of preventing a coagulation phenomenon of a detergent when the use of a detergent container capable of storing various kinds of detergents is changed.

In addition, the present application may provide a laundry treating apparatus capable of washing a detergent container when the type of a detergent stored in the detergent container is changed.

In addition, the present application may provide a laundry treating apparatus capable of preventing a detergent to be changed from being mixed with a previously stored detergent when the type of a detergent stored in the detergent container is changed.

In addition, the present application may provide a laundry treating apparatus capable of washing a flow path connected to a detergent container when the type of a detergent stored in the detergent container is changed.

Besides, the present application may provide a laundry treatment apparatus enabling a user to select whether to perform a washing after checking whether a detergent container needs to be washed.

BEST MODE

Figure 1:
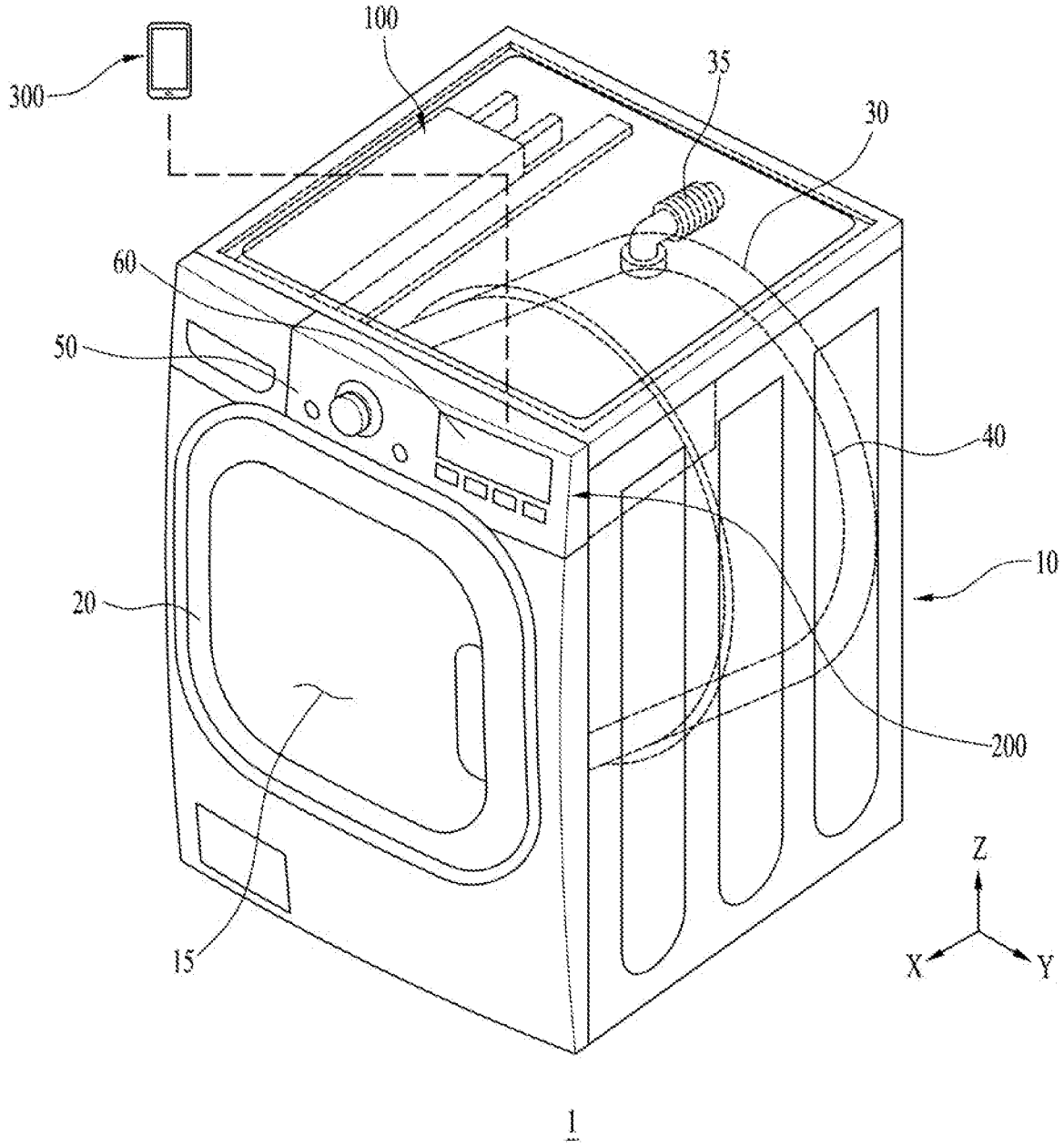
FIG. 1 is a perspective diagram illustrating a laundry treating apparatus according to one embodiment of the present disclosure.

Hereinafter, embodiments of the present disclosure will be described in detail with reference to the accompanying drawings.

Yet, the present disclosure may be implemented in a variety of different forms and is not limited to the embodiments described herein. In addition, in order to clearly describe the present disclosure in the drawings, parts that are not related to the description are omitted, and similar parts are denoted by similar reference numbers throughout the specification.

In the present specification, redundant descriptions of the same components will be omitted.

Further, in the present specification, it should be understood that when an element is referred to as 'be connected to' or 'access' another element, it may be directly connected to or access the corresponding element, but it should be understood that there may be other component in the middle. On the other hand, in the present specification, it should be understood that when an element is referred to as 'be directly connected' or 'directly access' another component, there is no other element in the middle.

Also, the terms used herein are used to describe specific embodiments only, and are not intended to limit the present disclosure.

In addition, in the present specification, the singular expression may include the plural expression unless the context clearly indicates otherwise.

It will be further understood that the terms "include" and/or "comprise," when used herein, specify the presence of stated features, integers, steps, operations, elements, components, and/or combinations thereof, but do not preclude the presence or addition of one or more other features, integers, steps, operations, elements, components, and/or combinations thereof.

As used herein, the term "and/or" includes a combination of a plurality of items or any one of a plurality of listed items. In the present specification, 'A' or 'B' may include 'A', 'B', or 'both A and B'.

Figure 2:
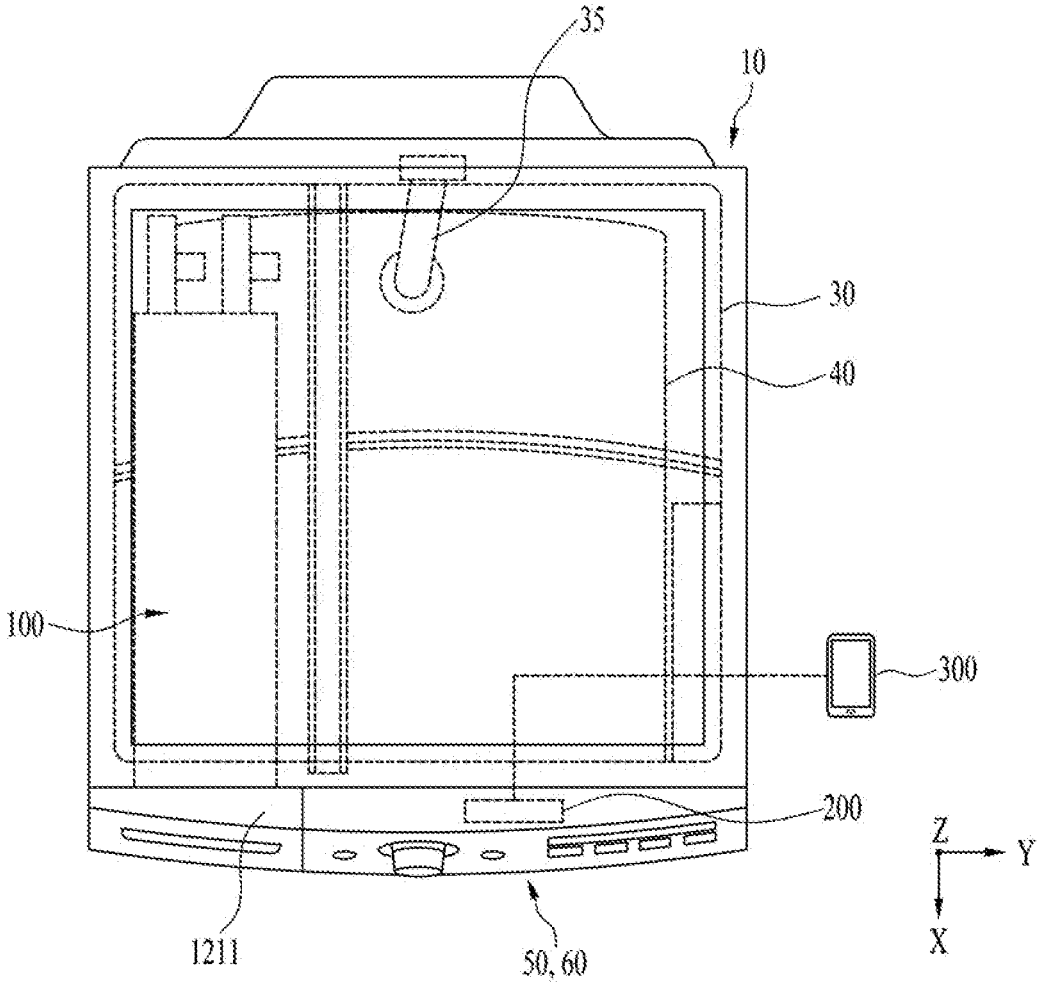
FIG. 2 is a top-view diagram illustrating a laundry treating apparatus according to one embodiment of the present disclosure.

FIG. 1 is a perspective diagram illustrating a laundry treating apparatus 1 according to one embodiment of the present disclosure, and FIG. 2 is a top-view diagram illustrating the laundry treating apparatus 1.

Referring to FIG. 1 and FIG. 2, a laundry treating apparatus 1 according to one embodiment of the present disclosure includes a cabinet 10 forming an exterior of the laundry treating apparatus 1, a tub 30 installed in the cabinet 10, a drum 40 rotatably installed in the tub 30, and a detergent supplier 100.

The laundry treating apparatus 1 according to one embodiment of the present disclosure may perform a washing cycle of laundry for removing contaminants from the laundry. The washing cycle may include a water supply process, a wash process, a rinse process, a spin process, a dry process, and the like.

The laundry treating apparatus 1 may be classified into a top loading type or a front loading type. FIG. 1 illustrates a front loading type laundry treating apparatus 1, which is only for convenience of description, and the present disclosure is not only applied to a front loading type washing machine, and thus may be applied to a top loading type washing machine as well.

However, for convenience of description, as shown in FIG. 1 and FIG. 2, one embodiment of the present disclosure will be described as a front loader type in which openings are formed in front surfaces of the tub 30 and the drum 40 so that laundry can be put into the tub 30 and the drum 40.

Meanwhile, the cabinet 10 may form an exterior of the laundry treating apparatus 1. The cabinet 10 may have a space formed therein such that the tub 30, the drum 40, the detergent supplier 100, and the like may be provided therein. Various components for operating the laundry treating apparatus 1 may be provided inside the cabinet 10.

The cabinet 10 may include a front plate, a rear plate, a top plate, a bottom plate, and a side plate. At least some of a plurality of the plates may be integrally molded with each other or may be separately manufactured and coupled together, thereby forming the cabinet 10.

Referring to FIG. 1, the front plate may be provided with a laundry opening 15 through which laundry is put into the cabinet 10. The laundry opening 15 may be provided to communicate with the inside of the tub 30 and the drum 40.

The front plate may be provided with a laundry door 20 for opening and closing the laundry opening 15. The laundry door 20 may be coupled to the front plate through a hinge part or the like to be rotatable.

However, the positions of the laundry opening 15 and the laundry door 20 are not necessarily limited to the front plate, and may be provided to the side plate, the rear plate, or the top plate as necessary.

Meanwhile, the tub 30 may be provided inside the cabinet 10 to accommodate water therein. In one embodiment of the present disclosure, the tub 30 may be provided in a cylindrical shape with an open front surface.

A tub opening formed in a front surface of the tub 30 may be disposed to face the laundry opening 15. Accordingly, the laundry put into the laundry treating apparatus 1 through the laundry opening 15 may be accommodated in the tub 30.

Meanwhile, the drum 40 may be rotatably provided in the tub 30. The drum 40 may be provided in a cylindrical shape, and a drum opening may be formed in a front surface of the drum 40. The front surface of the drum 40 may be opened as a whole to form the drum opening.

The drum opening may be provided in the tub 30 to face the tub opening and the laundry opening 15. Accordingly, the laundry put into the laundry treating apparatus 1 through the laundry opening 15 may be accommodated in the drum 40 through the tub opening and the drum opening.

In one embodiment of the present disclosure, water may be accommodated in the tub 30, and a tub water supply pipe 35 for supplying water into the tub 30 may be provided. The tub water supply pipe 35 may be connected to a water supply valve 140, which will be described later, or the detergent supplier 100 to allow water and/or detergent to flow.

A plurality of openings may be formed in the outer circumferential surface and/or a rear surface of the drum 40 disposed inside the tub 30, and thus water supplied into the tub 30 may be introduced into the drum 40. When water is discharged from the tub 30, water present in the drum 40 may also be discharged to the outside of the tub 30.

The drum 40 may be provided to be rotatable about a rotating shaft extending approximately in a front-rear direction. A driving unit for providing a rotational force for rotating the drum 40 may be coupled and fixed to the tub 30 or the cabinet 10. The driving unit may form a coupling relationship with the drum 40 at the rear of the drum 40, or may be disposed at a circumferential side of the drum 40, for example, a lower side of the drum 40 to form a connection relationship with the drum 40 through a belt or the like.

Meanwhile, as described above, water may be stored in the tub 30, and laundry put into the cabinet 10 through the laundry opening 15 of the cabinet 10 may be accommodated in the drum 40. When the drum 40 is rotated, a wash process may be performed in a manner of applying an external force corresponding to a frictional force with the drum 40 and the like to the laundry in a water-soaking state to remove contaminants therefrom.

Meanwhile, one embodiment of the present disclosure may include a controller 200. The controller 200 may be provided to a control panel, which is to be described later, or inside the cabinet 10. The controller 200 may have an electrical or signal connection relationship with a manipulation unit 50, a notification unit 60, a communication terminal 300, and the driving unit, which will be described later, and various programs for a wash cycle of laundry may be set.

As schematically shown in FIG. 1 and FIG. 2, the control panel including at least some of the manipulation unit 50 and the notification unit 60, which will be described later, are provided to the front plate and the controller 200 is embedded in the control panel.

Yet, the position of the controller 200 is not limited thereto, and a plurality of controllers 200 may be provided as necessary, or the controller 200 may be provided inside the cabinet 10 to be electrically or signally connected to the control panel.

For example, according to one embodiment of the present disclosure, a base portion for arranging various components may be provided to the bottom plate, and the controller 200 may be provided on the base portion.

Meanwhile, one embodiment of the present disclosure may include the manipulation unit 50 and the notification unit 60. Although the manipulation unit 50 and the notification unit 60 disposed on the front plate according to one embodiment of the present disclosure are illustrated in FIG. 1, the manipulation unit 50 and the notification unit 60 may be provided at various positions such as the top plate, the side plate, etc.

The manipulation unit 50 may be provided in the cabinet 10 to be manipulated by a user. The manipulation unit 50 may include various types of input devices that can be manipulated by the user.

For example, the manipulation unit 50 may include input devices such as a touch panel to which a user's touch signal may be inputted, a pressing button, a dial button, a microphone, etc. and a user may input a manipulation signal through the manipulation unit 50, and the manipulation signal may be transmitted to the controller 200 to be reflected in various ways with respect to the wash cycle of the laundry.

The notification unit 60 may be provided in the cabinet 10 to provide information to the user. The notification unit 60 may include various output devices for providing information to the user.

For example, the notification unit 60 may include a speaker for providing auditory information to the user, a light emitting unit or a display unit for providing visual information to the user.

The controller 200 may transmit various types of notification signals such as visual information, auditory information and the like to the user through the notification unit 60 to provide various kind of information related to an operation state or a dry cycle of the laundry treating apparatus 1.

The manipulation unit 50 and the notification unit 60 may be provided inside the cabinet 10 or may be provided to be exposed to the outside of the cabinet 10. FIG. 1 illustrates that the control panel including the manipulation unit 50 and the notification unit 60 is provided to the front plate according to one embodiment of the present disclosure.

Yet, the positions of the manipulation unit 50 and the notification unit 60 according to one embodiment of the present disclosure are not necessarily limited thereto, and may be independently provided in a manner of being separated from each other or provided at various positions such as the inside of the cabinet 10, the top plate, etc.

In addition, the manipulation unit 50 and the notification unit 60 according to one embodiment of the present disclosure may be provided at one side of the cabinet 10 at the same time to enable a user to input a signal through the manipulation unit 50 while checking information displayed on the notification unit 60.

Meanwhile, referring to FIG. 1 and FIG. 2, in one embodiment of the present disclosure, the controller 200 may be signal-connected to a portable communication terminal 300 by a user. The communication terminal 300 may be separated from the cabinet 10 to be independently movable, may include a communication function, and may be carried by the user.

For example, the communication terminal 300 may include a mobile phone that can be carried by a user. FIG. 1 and FIG. 2 2 schematically illustrate the communication terminal 300 corresponding to the mobile phone.

Yet, in one embodiment of the present disclosure, the communication terminal 300 is not necessarily limited thereto, and may include one of various types capable of communicating directly or indirectly with the controller 200.

The controller 200 may be provided to communicate with the communication terminal 300 in various ways. That is, the controller 200 may be signally connected to the communication terminal 300 through various schemes.

For example, the controller 200 may be directly connected to the communication terminal 300 through various schemes capable of transmitting and receiving wireless signals such as Wi-Fi, Bluetooth, NFC, etc., or may be indirectly connected with the communication terminal 300 using an intermediate means provided inside or outside the laundry treating apparatus 1 to transmit and receive communication signals.

For example, the controller 200 may be connected to a Wi-Fi module provided inside or outside the laundry treating apparatus 1 together with the communication terminal 300 to transmit/receive a signal to/from the communication terminal 300 through the Wi-Fi module.

Alternatively, the controller 200 may be signally connected to the communication terminal 300 through a communication server by transmitting/receiving signals to/from the communication server corresponding to a terminal base station or the like for communication of the communication terminal 300 in a manner of being connected to the Wi-Fi module or the like.

The communication scheme of the controller 200 is merely an example for describing one embodiment of the present disclosure, and is not limited to the above description. According to one embodiment of the present disclosure, the controller 200 and the communication terminal 300 may adopt various schemes capable of directly or indirectly transceiving signals with each other.

The user may input a manipulation signal by manipulating the communication terminal 300, and the controller 200 may transmit a notification signal to the user through the communication terminal 300. That is, the communication terminal 300 may correspond to the manipulation unit 50 and the notification unit 60 provided to the laundry treatment apparatus 1 according to one embodiment of the present disclosure.

According to one embodiment of the present disclosure, through not only the manipulation unit 50 and the notification unit 60 of the laundry treatment apparatus 1 but also the communication terminal 300 that can be carried by the user, a manipulation signal is received from the user or a notification signal is transmitted through the communication terminal 300, thereby effectively improving the convenience of use of the laundry treatment apparatus 1.

Meanwhile, FIG. 1 and FIG. 2 schematically illustrate the detergent supplier 100 embedded in the cabinet 10 in one embodiment of the present disclosure. One embodiment of the present disclosure may include the detergent supplier 100, and the detergent supplier 100 may be connected to the tub 30 to supply detergent into the tub 30.

The detergent supplier 100 may include a detergent storage space in which detergent is stored, and the detergent stored in the detergent storage space may be supplied to the tub 30 during the washing cycle of the laundry to perform the washing cycle.

In the present disclosure, the detergent may be of various types and forms. For example, the detergent may include a washing agent for decomposing and removing contaminants in the laundry, a softener for improving the flexibility of the laundry and protecting the fiber, a bleaching agent for decomposing and removing the colored material infiltrated into the laundry, etc.

The detergent may have various forms such as a solid form of powder, a liquid form, etc. In one embodiment of the present disclosure, the detergent may include various kinds of materials capable of caring the laundry and enhancing the washing effect.

Meanwhile, the detergent supplier 100 may be provided in various shapes at various positions. In FIG. 1 and FIG. 2, the detergent supplier 100 positioned at an upper portion of a front side within the cabinet 10 is illustrated, but is not limited thereto.

For example, the detergent supplier 100 may be disposed at a lower portion, a lateral side, or a rear side in the cabinet 10, and may be coupled to the cabinet 10 from the outside of the cabinet 10.

Hereinafter, for convenience of description, as shown in FIG. 1 and FIG. 2, the detergent supplier 100 may be described as embedded in the cabinet 10 unless mentioned otherwise, but the scope of the present disclosure is not limited thereto.

Figure 3:
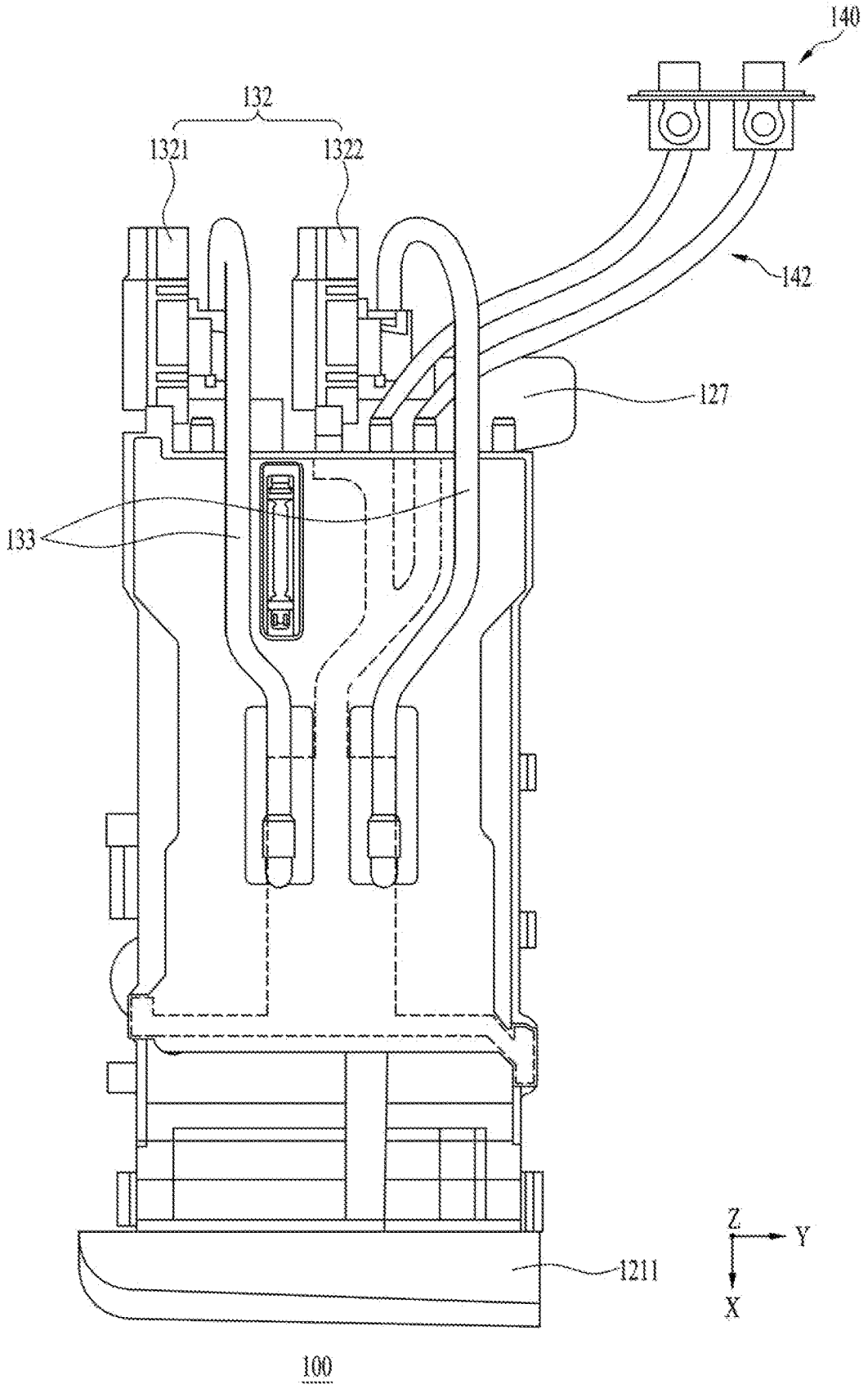
FIG. 3 is a top-view diagram illustrating a detergent supplier according to one embodiment of the present disclosure.
Figure 4:
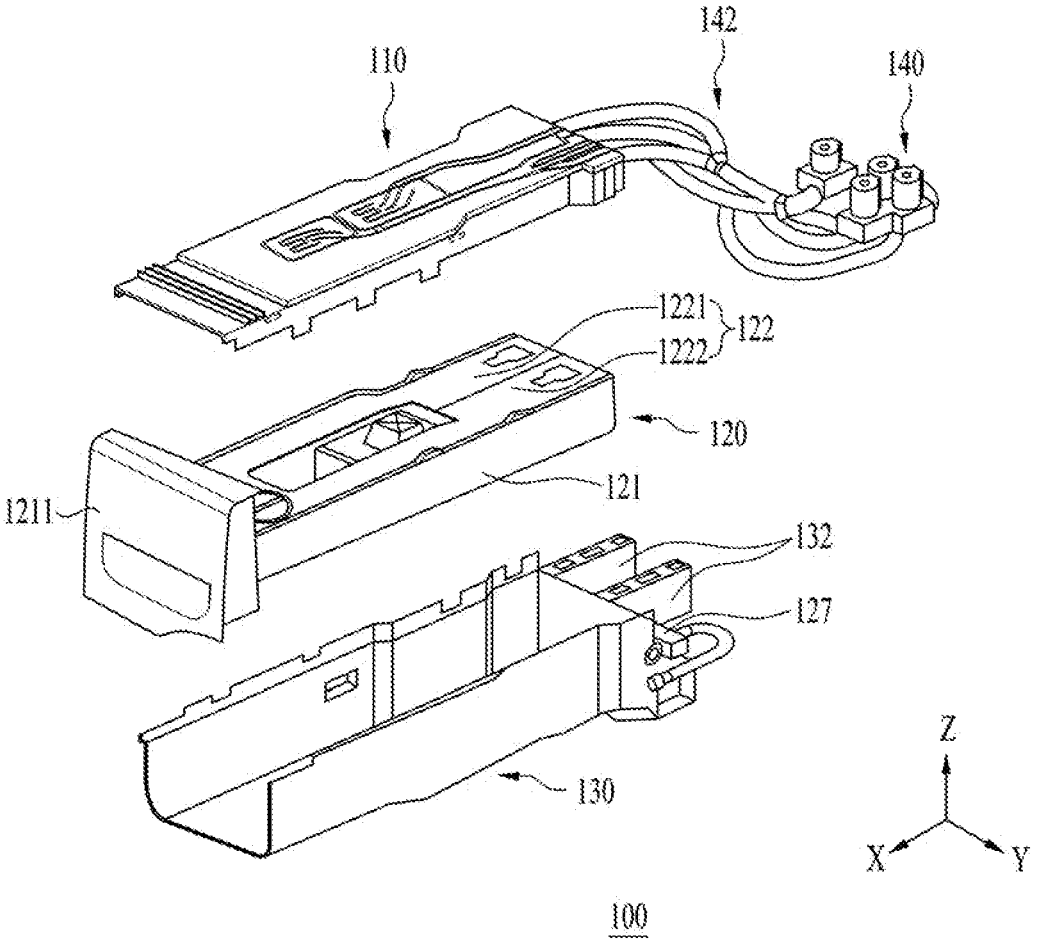
FIG. 4 is an exploded diagram showing a detergent supplier according to one embodiment of the present disclosure.

Meanwhile, FIG. 3 is a top-view diagram illustrating the detergent supplier 100 according to one embodiment of the present disclosure, and FIG. 4 is an exploded view of the detergent supplier 100 according to one embodiment of the present disclosure.

Referring to FIG. 3 and FIG. 4, in one embodiment of the present disclosure, the detergent supplier 100 may include a water supply unit 110, a detergent storage unit 120, and an accommodation case 130.

The water supply unit 110 may be provided to supply water to the detergent supplier 100 and connected to a water supply hose 142 extending from a water supply valve 140 to be supplied with water.

The water supply valve 140 may be connected to an external water supply source of the laundry treatment apparatus 1 according to one embodiment of the present disclosure to regulate the flow of water, and the water supply hose 142 connected to the water supply valve 140 may be a path through which water passing through the water supply valve 140 flows.

The water supply valve 140 may be connected to the tub water supply pipe 35 to regulate the flow of water supplied to the tub 30, and the water supply valve 140 may be connected to the tub water supply pipe 35 through the detergent supplier 100.

For example, the water supplied from the external water supply source and passing through the water supply valve 140 may be transferred to the water supply unit 110 through the water supply hose 142, and the water supplied to the detergent supplier 100 through the water supply unit 110 may be supplied into the tub 30 via the tub water supply pipe 35. However, the tub water supply pipe 35 may be directly connected to the water supply valve 140 separately from the water supply hose 142, and the water passing through the water supply valve 140 may be directly transferred to the tub water pipe 35.

Meanwhile, the detergent storage unit 120 may include the detergent storage space described above. In one embodiment of the present disclosure, the detergent storage unit 120 may include a detergent container 122 in which detergent is stored, and an inner space of the detergent container 122 may correspond to at least a portion of the detergent storage space.

The detergent storage unit 120 may be detachably provided to the detergent supplier 100. For example, the detergent storage unit 120 may be detached from the water supply unit 110 and the accommodation case 130, which will be described later, to be withdrawn out of the cabinet 10.

A user may withdraw the detergent storage unit 120 to the outside of the cabinet 10, supply a detergent to the detergent container 122, and then insert the detergent storage unit 120 into the cabinet 10, thereby storing the detergent in the detergent storage unit 120.

Yet, as described above, the shape of the detergent storage unit 120 is not necessarily limited as described above, and for example, at least a portion of the detergent supplier 100 may be disposed outside the cabinet 10, and the detergent container 122 may be coupled to the top plate, the front plate, or the like from the outside of the cabinet 10.

Meanwhile, in one embodiment of the present disclosure, the accommodation case 130 may be provided inside the cabinet 10 to accommodate the detergent storage unit 120 inserted into the cabinet 10. The water supply unit 110 may be provided to supply water into the detergent storage unit 120 accommodated in the accommodation case 130 and the inside of the accommodation case 130.

The accommodation case 130 may include an accommodation space in which the detergent storage unit 120 is accommodated. As one surface of the storage space is open, the water supply unit 110 may be disposed on the open one surface. For example, as shown in FIG. 4, in one embodiment of the present disclosure, the accommodation case 130 may be provided to have an upper surface that is open, and the water supply unit 110 may be positioned above the accommodation case 130 to form the upper surface of the accommodation case 130.

Accordingly, in one embodiment of the present disclosure, the detergent storage unit 120 may be defined by the water supply unit 110 and the accommodation case 130, and may be inserted into the accommodation space from the front to the rear of the accommodation space that is opened forward.

In one embodiment of the present disclosure, the water transferred to the water supply unit 110 through the water supply valve 140 and the water supply hose 142 may be discharged into the detergent storage unit 120 and the accommodation case 130 through the water supply unit 110.

The water supplied from the water supply unit 110 to the detergent storage unit 120 may be discharged to the outside of the detergent storage unit 120 together with the detergent of the detergent storage unit 120. Water and detergent discharged from the detergent storage unit 120 may be transferred to the accommodation space of the accommodation case 130.

The accommodation case 130 may discharge the water discharged from the water supply unit 110 and the detergent discharged from the detergent storage unit 120 to the outside through a drain hole 131. The water and detergent discharged through the drain hole 131 may be transferred to the tub water supply pipe 35 and then supplied into the tub 30.

The drain hole 131 of the accommodation case 130 may communicate with the inside of the tub 30 through a separate water supply pipe independently provided with respect to the tub water supply pipe 35. For example, the water and detergent discharged from the drain hole 131 may flow along a detergent supply pipe, which is separately provided with respect to the tub water supply pipe 35 and extended from the drain hole 131, and may be then supplied into the tub 30 through a tub opening or a hole formed in an outer surface of the tub 30.

Figure 5:
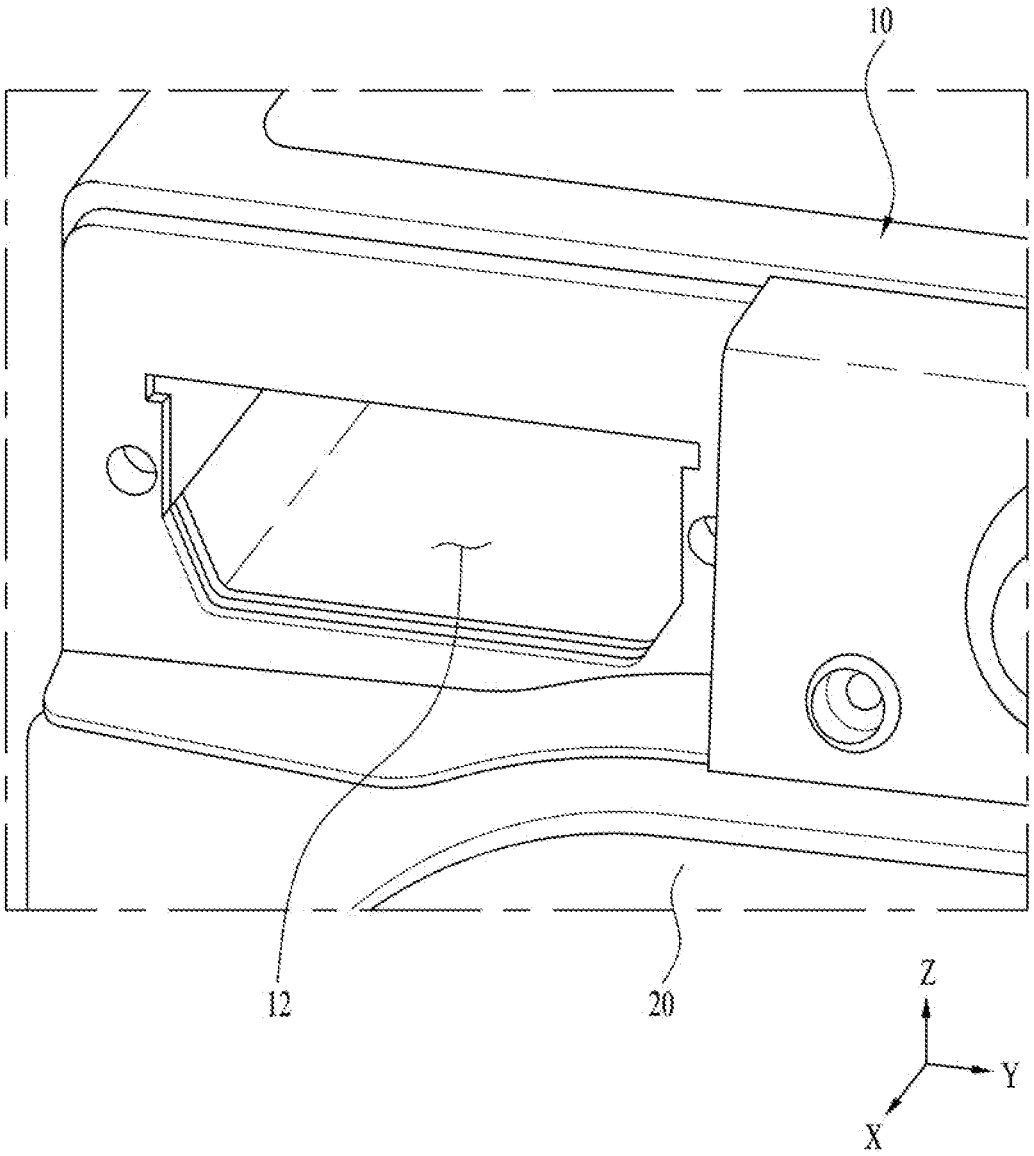
FIG. 5 is a diagram illustrating a detergent opening formed in a cabinet in one embodiment of the present disclosure.
Figure 6:
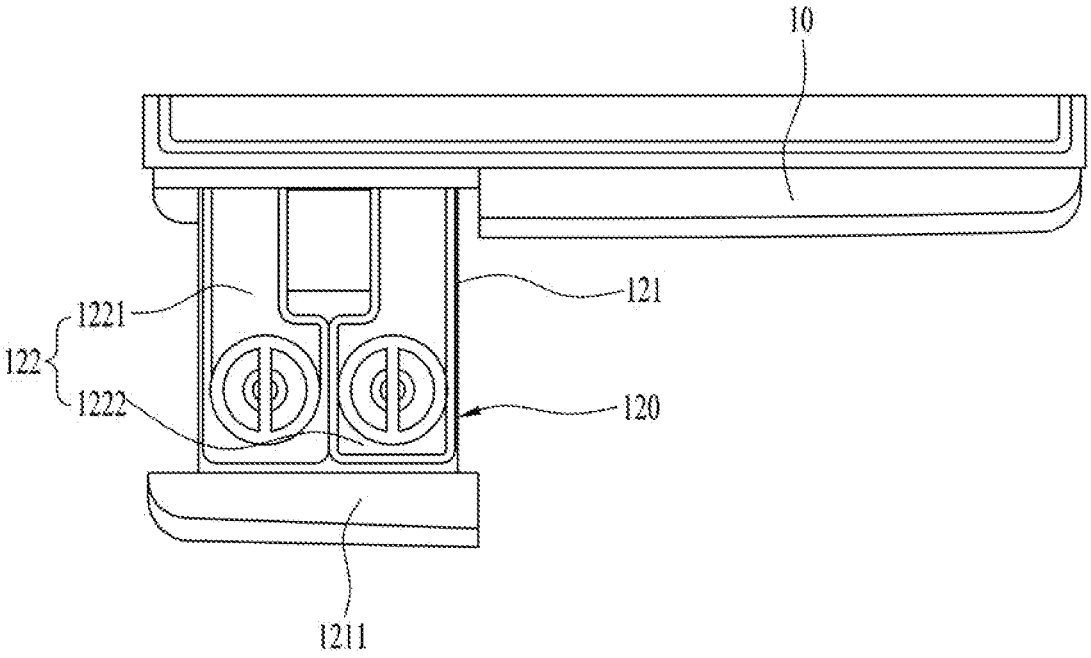
FIG. 6 is a diagram illustrating a detergent storage unit inserted into a cabinet through a detergent opening in one embodiment of the present disclosure.

Meanwhile, FIG. 5 illustrates a detergent opening 12 formed in the cabinet 10, and FIG. 6 illustrates the detergent storage unit 120 inserted into the cabinet 10 through the detergent opening 12.

As described above, in one embodiment of the present disclosure, the detergent storage unit 120 may include the detergent container 122, and may be separated from the detergent supplier 100 to be withdrawn to the outside of the cabinet 10.

The cabinet 10 may include the detergent opening 12 penetrated by the detergent storage unit 120. As shown in FIG. 5, the detergent opening 12 may be provided in the front plate at a position spaced apart from a laundry opening 15, but is not limited thereto.

The detergent storage unit 120 may include a storage frame 121 and a handle 1211. The detergent container 122 may be coupled onto the storage frame 121 to be inserted into or withdrawn from the cabinet 10 together with the storage frame 121.

The handle 1211 may be located at a front end of the storage frame 121. In a state in which the detergent storage unit 120 is completely inserted into the cabinet 10, the handle 1211 may be provided to be exposed to the outside of the cabinet 10 and gripped by a user.

As shown in FIG. 5 and FIG. 6, when the detergent opening 12 is provided in the front plate of the cabinet 10, the detergent storage unit 120 may be inserted into the cabinet 10 through the detergent opening 12 of the front plate, and the handle 1211 may be positioned outside the cabinet 10 to form a front side exterior of the laundry treating apparatus 1 together with the front plate.

Figure 7:
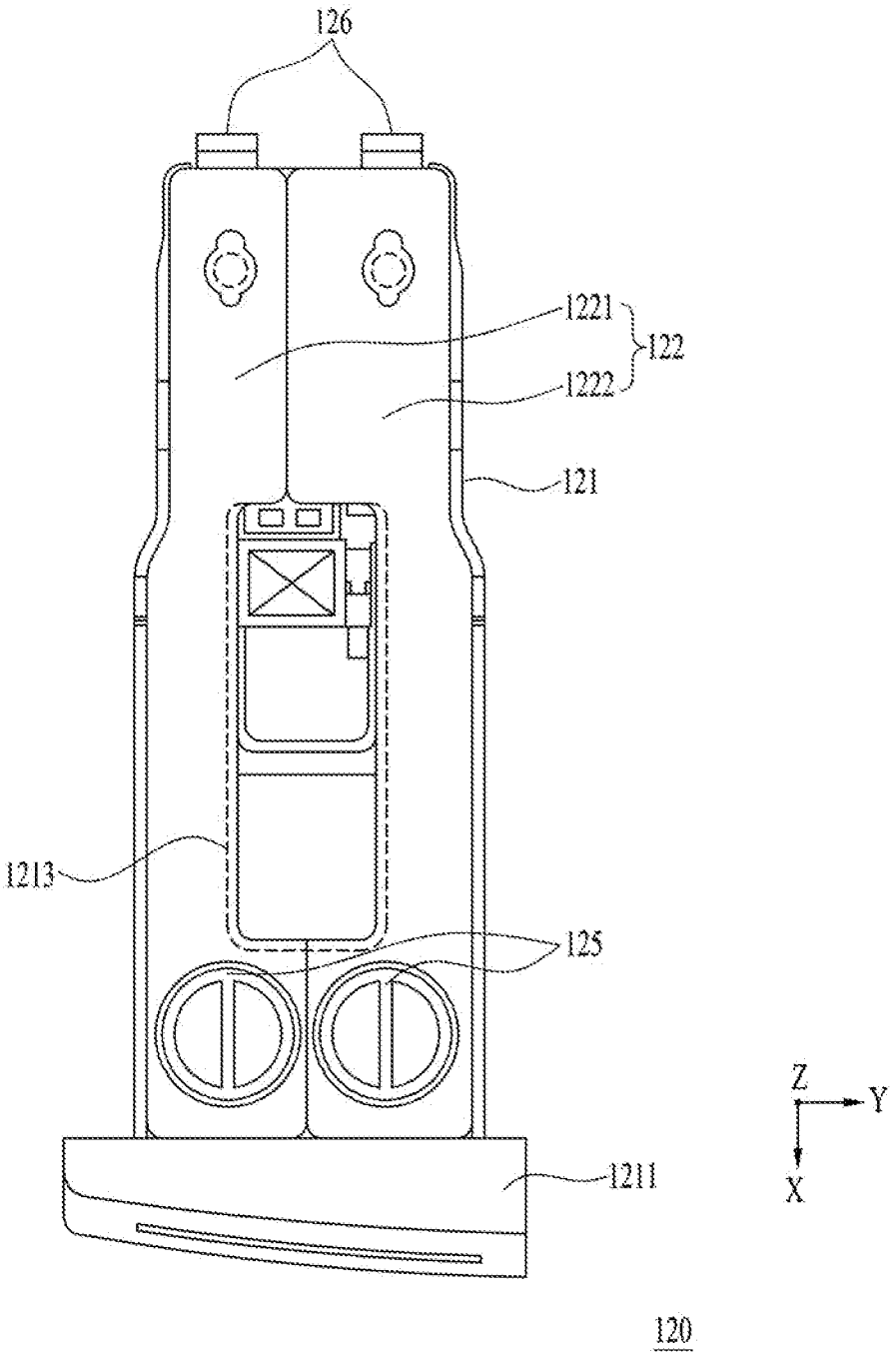
FIG. 7 is a top-view diagram illustrating a detergent storage unit of a detergent supplier according to one embodiment of the present disclosure.
Figure 8:
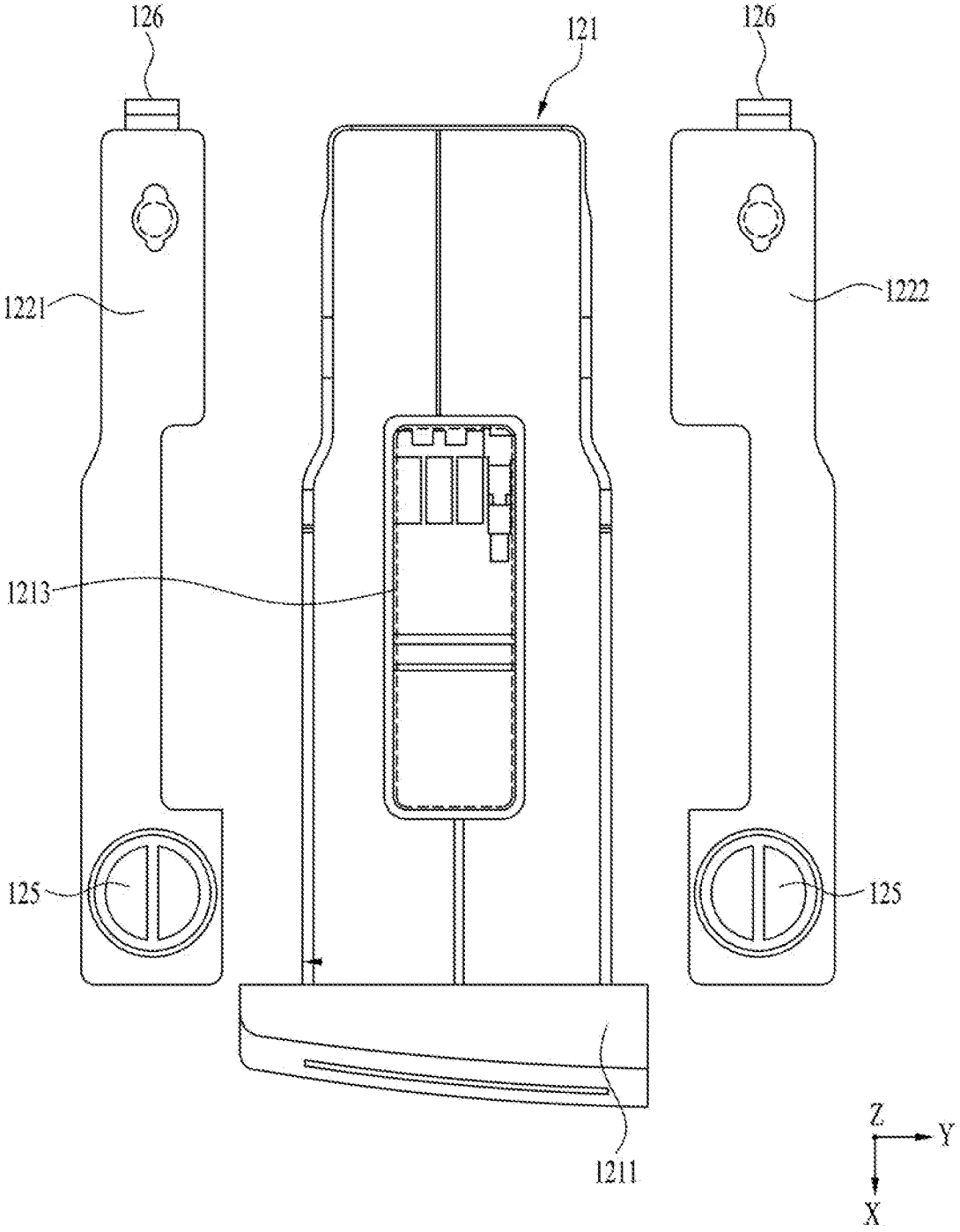
FIG. 8 is an exploded diagram illustrating a detergent storage unit of a detergent supplier according to one embodiment of the present disclosure.

Meanwhile, FIG. 7 is a top view of the detergent storage unit 120 according to one embodiment of the present disclosure, and FIG. 8 is a diagram illustrating a state in which the detergent container 122 is separated from the detergent storage unit 120 according to one embodiment of the present disclosure.

As described above, the detergent storage unit 120 may include a storage frame 121 and the detergent container 122, the storage frame 121 may include the above-described handle 1211, and a coupling space to which the detergent container 122 is coupled may be formed therein.

In addition, the storage frame 121 may include a detergent accommodation area 1213 in which a detergent may be independently stored with respect to the detergent container 122. The detergent accommodation area 1213 may correspond to a portion of the detergent storage space described above. That is, in one embodiment of the present disclosure, the detergent storage unit 120 may store detergent in the detergent storage space including the inner space of the detergent container 122 and the detergent accommodation area 1213.

In one embodiment of the present disclosure, the detergent storage unit 120 may include a plurality of detergent containers 122. For example, as shown in FIG. 7 and FIG. 8, the detergent container 122 may include a first detergent container 1221 and a second detergent container 1222. However, the number of the detergent containers 122 may vary as necessary.

The first detergent container 1221 and the second detergent container 1222 may be provided independent from each other to store different detergents, respectively. In addition, the detergent accommodation area 1213 described above may be partitioned from the first detergent container 1221 and the second detergent container 1222 to store another detergent.

For example, a liquid detergent may be stored in the detergent container 122 in which watertightness is secured, and a powdered detergent may be stored in the detergent accommodation area 1213 in which the detergent may be easily replenished. The present disclosure is not limited thereto necessarily. Various types and forms of detergents may be stored in the detergent container 122 and the detergent accommodation area 1213.

Figure 9:
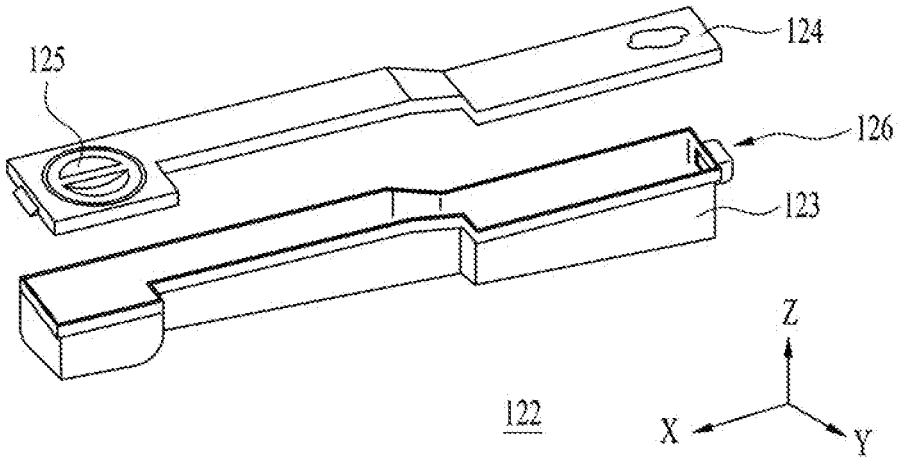
FIG. 9 is an exploded diagram illustrating a detergent container of a detergent storage unit according to one embodiment of the present disclosure.

Meanwhile, FIG. 9 illustrates an exploded view of the detergent container 122 according to one embodiment of the present disclosure. Referring to FIG. 9, in one embodiment of the present disclosure, the detergent container 122 may include a storage body 123 and a storage cover 124.

A storage space in which detergent is stored may be formed in the storage body 123. As an upper surface of the storage body 123 is open, the storage body 123 may be exposed upward. The storage cover 124 may be coupled to the storage body 123 to shield the open upper surface of the storage body 123.

Yet, the present disclosure is not limited thereto, and the storage body 123 and the storage cover 124 may be integrally molded to form a sealed storage space.

Meanwhile, a detergent cap 125 may be provided to the storage cover 124. The storage cover 124 may include an opening, and the detergent cap 125 may be detachably coupled to the storage cover 124 to shield the opening.

According to one embodiment of the present disclosure, an opening communicating with the storage space inside the detergent container 122 is formed in the storage cover 124, and the opening is shielded through the detergent cap 125 detachably coupled to the storage cover 124. Accordingly, although a user does not separate the detergent container 122 from the storage frame 121 or the user does not separate the storage cover 124 from the storage body 123, the user may conveniently separate the detergent cap 125 from the storage cover 124, thereby supplying the detergent into the detergent container 122 through the opening of the storage cover 124.

Figure 10:
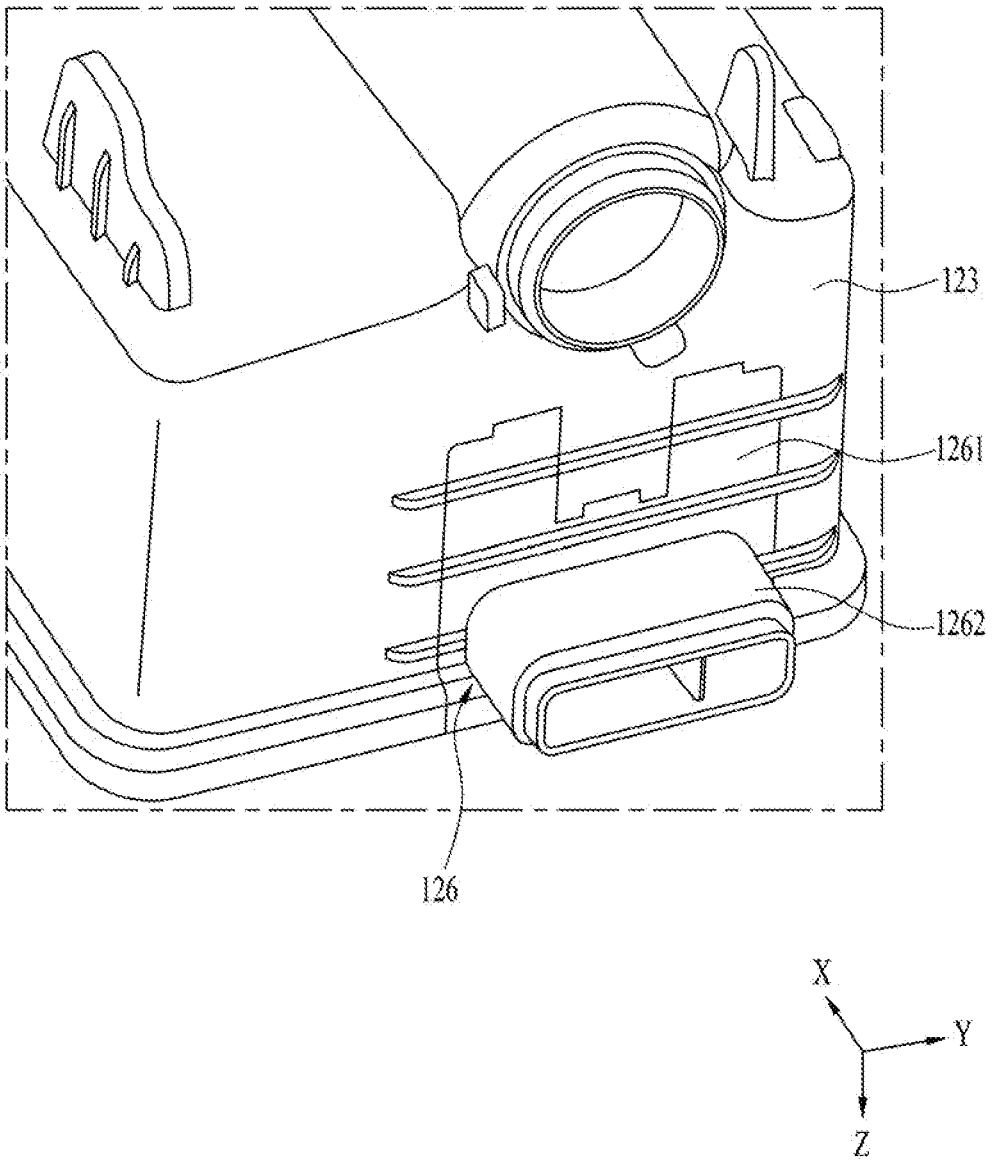
FIG. 10 is a diagram illustrating a residual amount sensing unit of a detergent container according to one embodiment of the present disclosure.

Meanwhile, FIG. 10 illustrates a residual amount sensing unit 126 provided to the detergent container 122. Referring to FIG. 9 and FIG. 10, one embodiment of the present disclosure may include a residual amount sensing unit 126 capable of sensing a residual detergent amount in each of the first detergent container 1221 and the second detergent container 1222.

The residual amount sensing unit 126 may be provided to the storage frame 121 or the accommodation case 130, or may be provided to the detergent container 122. FIG. 10 illustrates the residual amount sensing unit 126 provided on a rear surface of the storage body 123 of the detergent container 122 according to one embodiment of the present disclosure.

In one embodiment of the present disclosure, the residual amount sensing unit 126 may be provided to form at least a portion of the rear surface of the storage body 123, and may include a contact portion in contact with the detergent to sense or detect a residual amount of the detergent.

For example, a plurality of contact portions may be provided to apply an electric current to each other as a result of a contact with a detergent, and thus, the residual amount of the detergent may be measured through whether the electric current is applied to the contact portion.

The residual amount sensing unit 126 may be provided to each of the first detergent container 1221 and the second detergent container 1222 to sense a residual detergent amount of each of the first detergent container 1221 and the second detergent container 1222, and may be connected to the controller 200 to transmit a sensing signal for the residual amount to the controller 200.

Meanwhile, the residual amount sensing unit 126 may include a sensing body 1261 and a sensing terminal 1262, and the sensing body 1261 may form at least a portion of the storage body 123. The sensing body 1261 may be provided with the above-described contact portion, and the contact portion may be exposed to the storage space to be in contact with the detergent.

A wire or the like may be connected to the sensing terminal 1262 to be electrically or signal-connected to the controller 200, and an electrical signal generated from the contact between the contact portion and the detergent may be transferred from the sensing terminal 1262 to the controller 200 through the wire or the like. The controller 200 may receive the electrical signal transmitted through the sensing terminal 1262 to identify the residual detergent amount in the detergent container 122.

Yet, in one embodiment of the present disclosure, the type, position, and shape of the residual amount sensing unit 126 are not limited as described above, and various types of the residual amount sensing units 126 may be provided at various positions as necessary.

Figure 11:
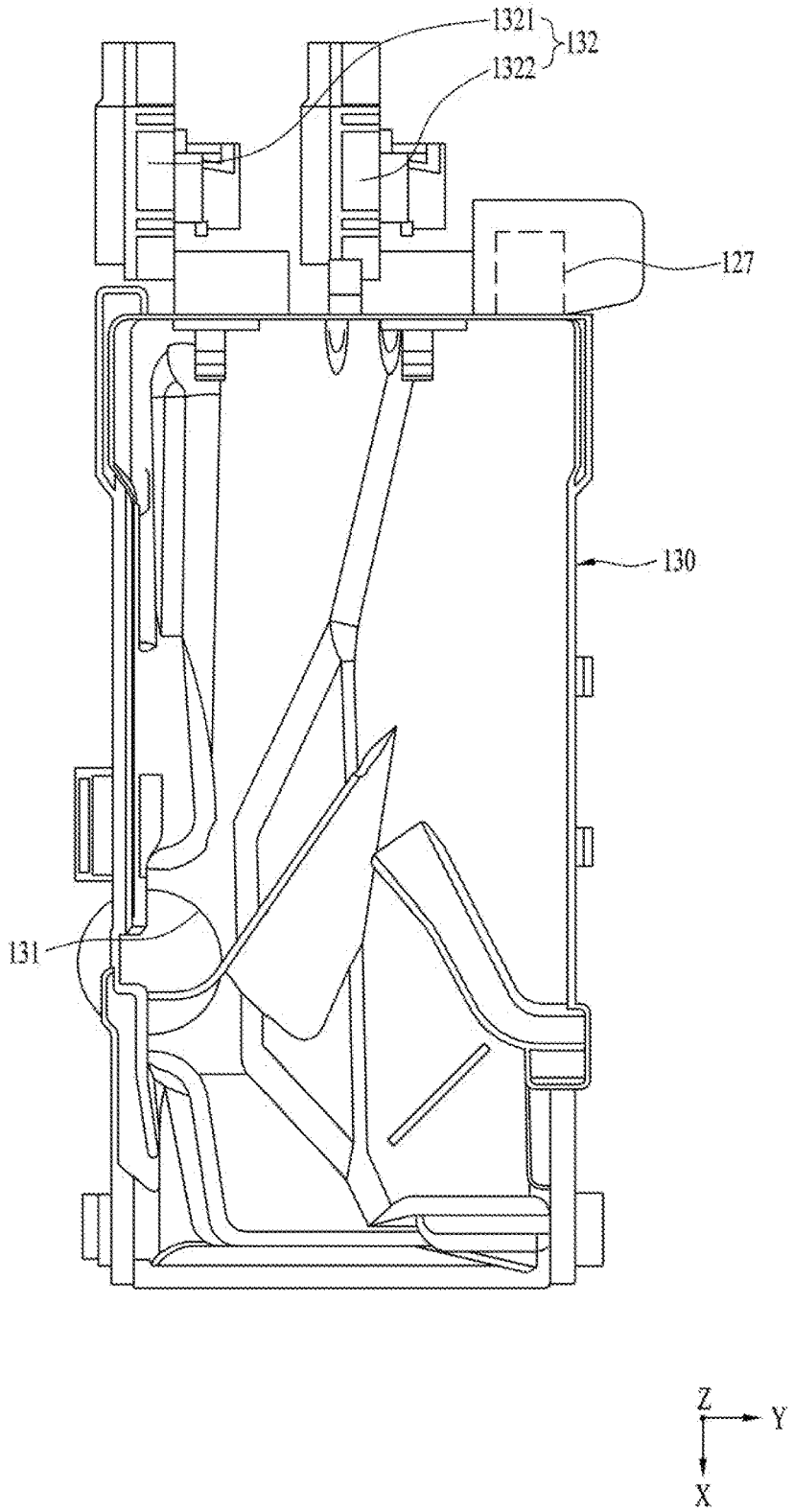
FIG. 11 is a top-view diagram illustrating an accommodation case of a detergent supplier according to one embodiment of the present disclosure.

Meanwhile, FIG. 11 illustrates the accommodation case 130 according to one embodiment of the present disclosure. Referring to FIG. 11, one embodiment of the present disclosure may include a detergent container sensing unit 127 for sensing whether the first detergent container 1221 and the second detergent container 1222 are inserted into the accommodation case 130.

In one embodiment of the present disclosure, the first detergent container 1221 and the second detergent container 1222 may be detachably provided to the detergent supplier 100. That is, the first detergent container 1221 and the second detergent container 1222 may be detachably coupled to the detergent supplier 100.

A coupling mechanism between the first detergent container 1221 and the second detergent container 1222 and the detergent supplier 100 may vary. For example, as described above, the first detergent container 1221 and the second detergent container 1222 may be coupled to the storage frame 121 to be inserted into or withdrawn from the cabinet 10.

In addition, at least a portion of the detergent supplier 100 may be provided to be exposed to the outside of the cabinet 10, and the first detergent container 1221 and the second detergent container 1222 may be detachably coupled to a portion exposed to the outside from the detergent supplier 100.

Hereinafter, for convenience of description, the first detergent container 1221 and the second detergent container 1222 may are described based on that they are inserted into the cabinet 10 in a state of being coupled to the storage frame 121 of the detergent storage unit 120 or drawn out of the cabinet 10 in the same state to be detached from the detergent supplier 100.

The detergent container sensing unit 127 may be provided to sense whether the first detergent container 1221 and the second detergent container 1222 are coupled to the detergent supplier 100, for example, the accommodation case 130. The detergent container sensing unit 127 may be provided to the storage frame 121 of the detergent storage unit 120 or may be provided to the accommodation case 130.

FIG. 11 schematically illustrates the detergent container sensing unit 127 disposed on a rear surface of the accommodation case 130 according to one embodiment of the present disclosure. Referring to FIG. 11, the detergent container sensing unit 127 may be provided to the accommodation case 130 to sense whether the detergent storage unit 120 is inserted, thereby sensing whether the first detergent container 1221 and the second detergent container 1222 are mounted.

For example, the detergent container sensing unit 127 may be configured to generate an electrical signal when pressed or touched by the storage frame 121 accommodated in the accommodation case 130. Since the first detergent container 1221 and the second detergent container 1222 are inserted into the cabinet 10 together with the storage frame 121, a sensing signal of the detergent container sensing unit 127 may mean that the first detergent container 1221 and the second detergent container 1222 are mounted on the detergent supplier 100.

The detergent container sensing unit 127 may be electrically or signally connected to the controller 200, and the controller 200 may determine whether the first detergent container 1221 and the second detergent container 1222 are accommodated through the electrical signal of the detergent container sensing unit 127.

Figure 12:
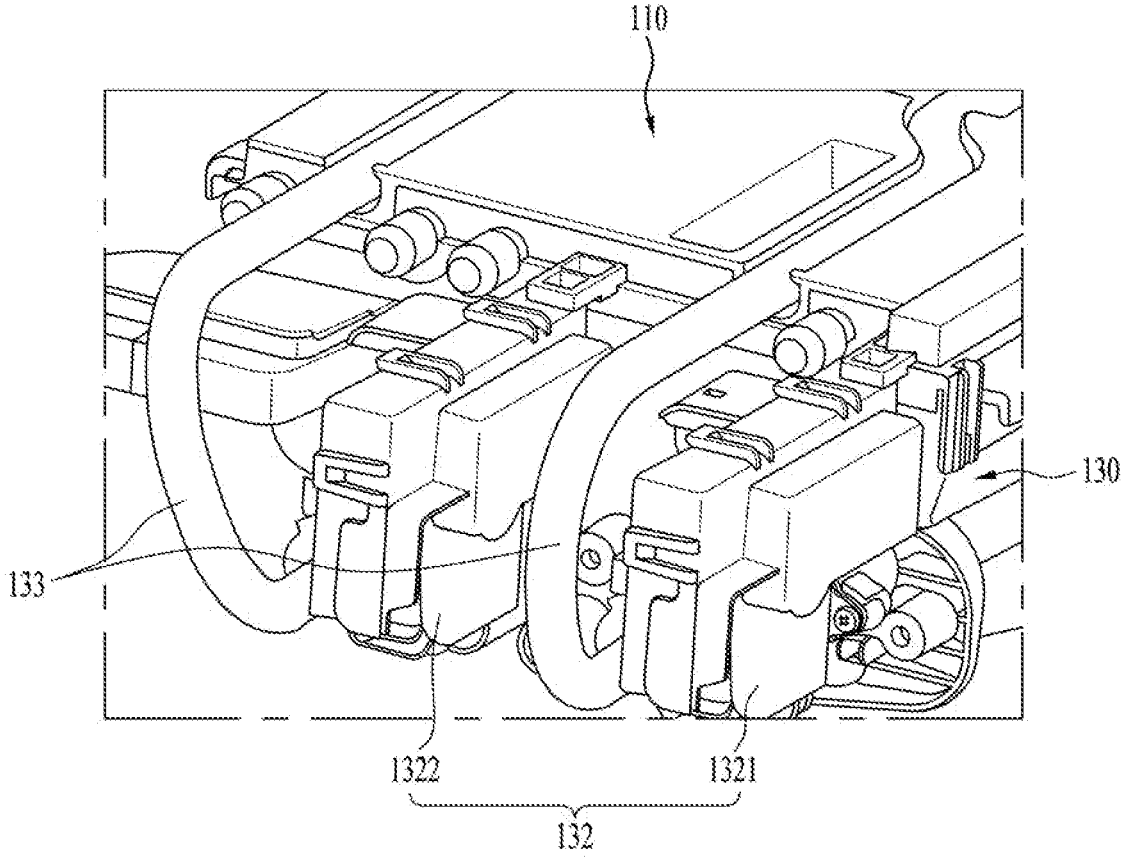
FIG. 12 is a diagram illustrating a detergent pump of a detergent supplier according to one embodiment of the present disclosure.

Meanwhile, FIG. 12 illustrates a detergent pump 132 and a detergent hose 133 provided to the accommodation case 130. Referring to FIG. 11 and FIG. 12, one embodiment of the present disclosure may include a detergent pump 132 for discharging detergent stored in the detergent container 122.

As described above, the detergent container 122 may include the first detergent container 1221 and the second detergent container 1222, and the detergent pump 132 may include a first detergent pump 1321 connected to the first detergent container 1221 and a second detergent pump 1322 connected to the second detergent container 1222.

The detergent pump 132 may be provided to the accommodation case 130. As described above, according to one embodiment of the present disclosure, the detergent storage unit 120 may be inserted into the cabinet 10 through the detergent opening 12 provided in the front plate, and the detergent pump 132 may be disposed on the rear surface of the accommodation case 130 to be connected to the detergent container 122 of the detergent storage unit 120 completely accommodated in the accommodation case 130.

The detergent pump 132 may be provided to discharge detergent in the detergent container 122. For example, a liquid detergent may be stored in the detergent container 122, and the detergent pump 132 may discharge the liquid detergent in the detergent container 122 to the outside of the detergent container 122.

The detergent discharged from the detergent container 122 through the detergent pump 132 may flow through the detergent hose 133 connected to the detergent pump 132. The detergent discharged from the detergent container 122 through the detergent pump 132 may be finally provided into the tub 30.

The detergent discharged through the detergent pump 132 may be supplied into the tub 30 in various ways. For example, the detergent hose 133 may be connected to the tub 30, the tub water supply pipe 35, and the like from the detergent pump 132, and the detergent discharged from the detergent container 122 through the detergent pump 132 may be supplied to the inside of the tub 30 or the tub water supply pipe 35 along the detergent hose 133.

In addition, the detergent hose 133 extending from the detergent pump 132 may be provided to communicate with the inside of the accommodation case 130. Accordingly, the detergent discharged from the detergent container 122 may be discharged into the accommodation case 130 by flowing along the detergent hose 133, and the detergent inside the accommodation case 130 may flow into the tub 30 through the drain hole 131 of the accommodation case 130 together with the water supplied from the water supply unit 110.

In addition, the detergent hose 133 extending from the detergent pump 132 may be connected to the water supply unit 110. Accordingly, the detergent discharged from the detergent container 122 may be supplied to the water supply unit 110, the water supply unit 110 may be provided to discharge water and detergent together into the accommodation case 130, and the water and detergent in the accommodation case 130 may be transferred into the tub 30 through the drain hole 131 as described above.

FIG. 12 illustrates the detergent pump 132 coupled to the rear surface of the accommodation case 130 in rear thereof according to one embodiment of the present disclosure, and the detergent hose 133 extending from the detergent pump 132 and connected to the water supply unit 110 is illustrated. Once the detergent pump 132 is operated, the detergent stored in the detergent container 122 may be moved to the water supply unit 110 through the detergent pump 132 and the detergent hose 133.

Figure 13:
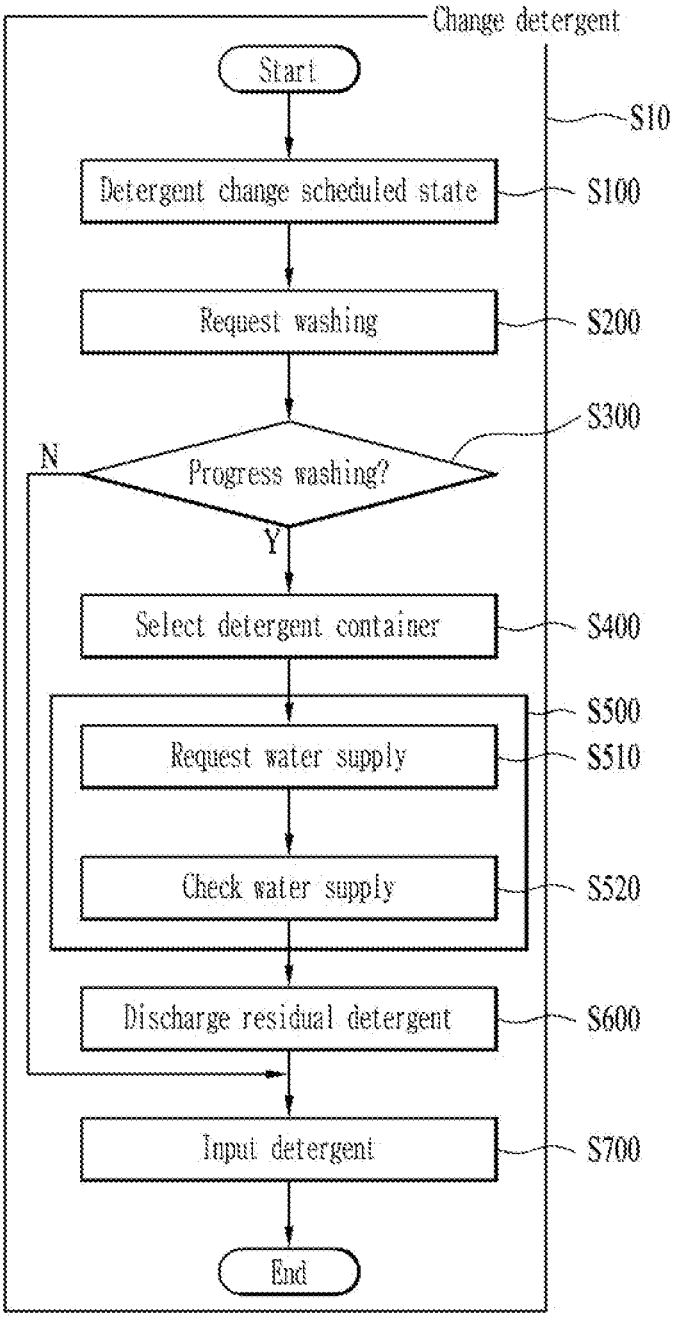
FIG. 13 is a conceptual diagram illustrating a process of changing a detergent in a detergent supplier according to one embodiment of the present disclosure.

Meanwhile, FIG. 13 illustrates a process of changing a detergent according to one embodiment of the present disclosure.

When a type of a detergent stored in the first detergent container 1221 or the second detergent container 1222 is changed, that is, when the use of the detergent container is changed, the detergent container 122 needs be washed occasionally before supplying a new detergent to the detergent container 122.

For example, as described above, various types of detergents may be stored in the first detergent container 1221 and the second detergent container 1222. A washing agent for removing contaminants, a softener for improving the flexibility of the fiber, and the like may be stored.

However, when the washing agent and the softener are mixed, a phenomenon in which the washing agent and the softener are coagulated may occur. When the washing agent is coagulated, it may not be dissolved well in water. Moreover, the washing agent may be clogged to block a flow path through which the detergent moves. Accordingly, the detergent supply of the detergent supplier may not be smoothly performed.

In order to prevent such a problem from occurring, when the detergent stored in the first detergent container 1221 or the second detergent container 1222 is scheduled to be changed, that is, when a specific detergent container 122 corresponds to a detergent change scheduled state S100, the corresponding detergent container 122 may be washed to prevent a previously stored detergent and a newly stored detergent from being mixed together.

That is, before a new detergent is supplied, all of the detergent accommodated in the detergent container 122 may be discharged or water may be used to wash the inside of the detergent container 122. Washing the detergent container may mean discharging all the liquid accommodated therein by operating the detergent pump 132. In addition, rinsing the detergent container 122 and the detergent hose 133 by discharging the water supplied separately to the detergent container 122 by operating the detergent pump 132 may be included.

Meanwhile, referring to FIG. 13, when a change of a detergent stored in the first detergent container 1221 or the second detergent container 1222 corresponds to a detergent change scheduled state S100, the controller 200 may perform a residual detergent discharge step S600 of driving the detergent pump 132 to discharge the residual detergent of the first detergent container 1221 or the second detergent container 1222 corresponding to the detergent change scheduled state S100.

Specifically, if the first detergent container 1221 corresponds to the detergent change scheduled state S100, the controller 200 may operate the first detergent pump 1321 to discharge the residual detergent stored in the first detergent container 1221. In addition, when the second detergent container 1222 corresponds to the detergent change scheduled state S100, the controller 200 may operate the second detergent pump 1322 to discharge the residual detergent stored in the second detergent container 1222.

In addition, when the first detergent container 1221 and the second detergent container 1222 correspond to the detergent change scheduled state S100, the controller 200 may operate both the first detergent pump 1321 and the second detergent pump 1322 to discharge the residual detergents stored in the first detergent container 1221 and the second detergent container 1222.

In other words, the controller 200 may independently control the first detergent pump 1321 and the second detergent pump 1322, and the controller 200 may independently perform the residual detergent discharge step S600 of each of the first detergent container 1221 and the second detergent container 1222.

Meanwhile, the controller 200 may determine whether to correspond to the detergent change scheduled state S100 based on a manipulation signal inputted through the manipulation unit 50 or the communication terminal 300 that can be carried by a user. That is, when a specific signal is inputted by the user, the controller 200 may recognize that the first detergent container 1221 or the second detergent container 1222 corresponds to the detergent change scheduled state (S100).

Figure 14:
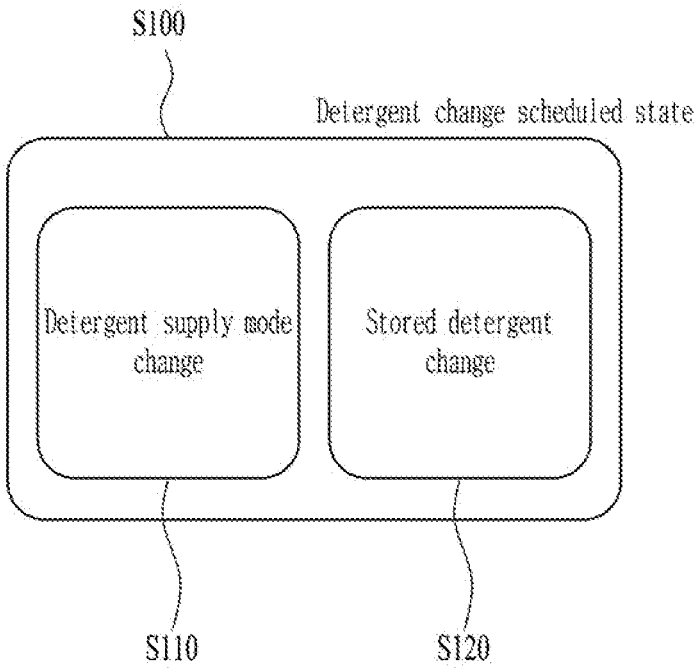
FIG. 14 is a conceptual diagram illustrating an example of a detergent change scheduled status according to one embodiment of the present disclosure.

FIG. 14 illustrates an example of a specific signal recognized by the controller 200 as the detergent change scheduled state S100. The specific signal recognized by the controller 200 as the detergent change scheduled state S100 is not limited to the drawings, and may include various situations.

For example, when the detergent stored in the first detergent container 1221 is scheduled to be changed between the washing agent and the softener, the controller 200 may determine that the first detergent container 1221 corresponds to the detergent change scheduled state S100. The controller 200 may determine whether the second detergent container 1222 corresponds to the detergent change scheduled state S100 in the same manner as the first detergent container 1221.

More specifically, the controller 200 may determine that the first detergent container corresponds to the detergent change scheduled state S100 when the first detergent container 1221 stores the softener instead of the washing agent in a state that the laundry agent is stored in the first detergent container 1221. Even when the softener is stored previously, if it is intended to change the stored detergent into the washing agent, the controller 200 may make the same determination.

When a signal for changing a detergent supply mode is inputted or a signal for changing a detergent to be stored in the first detergent container 1221 or the second detergent container 1222 is inputted, the controller 200 may recognize it as corresponding to the detergent change scheduled state S100.

Figure 15:
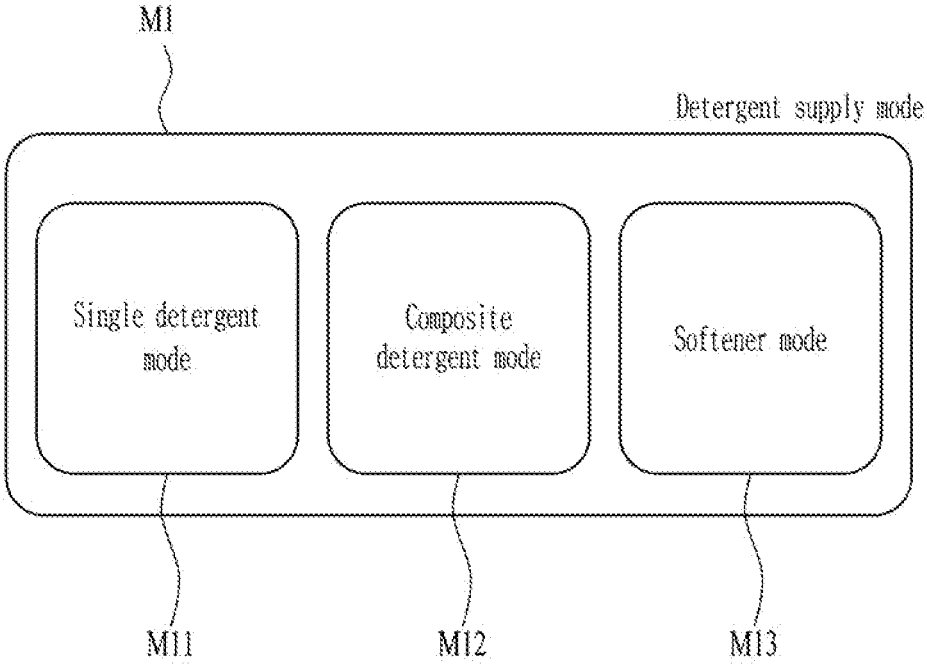
FIG. 15 is a diagram illustrating an example of a detergent supply mode according to one embodiment of the present disclosure.

FIG. 15 illustrates an example of a detergent supply mode.

Referring to FIG. 15, a detergent supply mode M1 may include a single detergent mode M11, a composite detergent mode M12, and a softener mode M13. The detergent supply mode M1 is not limited to the illustrated types and may include various modes. Yet, for convenience of description, the detergent supply mode M1 will be described as including three modes.

The single detergent mode M11 may refer to a mode in which a washing agent is supplied from one of the first detergent container 1221 and the second detergent container 1222 to the tub 30 during the operation of the laundry treating apparatus. That is, the washing agent may be stored in each of the first detergent container 1221 and the second detergent container 1222. The types of the stored washing agents may be different, but the type of the stored detergent may correspond to a washing agent that removes contamination of laundry. In other words, the same type of a first washing agent may be stored in each of the first detergent container 1221 and the second detergent container 1222. Alternatively, the first detergent container 1221 may store the first washing agent, and a second washing agent may be stored in the second detergent container 1222. Yet, in a detergent supply process, supplying the washing agent from one of the first detergent container 1221 and the second detergent container 1222 may be defined as the single detergent mode M11.

In addition, the detergent supply mode M1 may include the composite detergent mode M12. The composite detergent mode M12 may refer to a mode in which the washing agent is supplied from each of the first detergent container 1221 and the second detergent container 1222 to the tub 30. Different types of detergents may be stored in the first detergent container 1221 and the second detergent container 1222, respectively, or the same kind of detergent may be stored therein. Yet, the washing agent is stored in both the first detergent container 1221 and the second detergent container 1222, and supplying the washing agent from each of the first detergent container 1221 and the second detergent container 1222 in the detergent supply process may be defined as the composite detergent mode M12.

In addition, the detergent supply mode M1 may include the softener mode M13. The softener mode M13 may refer to a mode in which a washing agent is supplied from one of the first detergent container 1221 and the second detergent container 1222 to the tub 30 and the other of the first detergent container 1221 and the second detergent container 1222 supplies a softening agent to the tub 30. That is, in the softener mode M13, the washing agent may be stored in any one of the first detergent container 1221 and the second detergent container, and the softening agent may be stored in the other one of the first detergent container 1221 and the second detergent container.

The controller 200 may selectively perform any one of the single detergent mode M11, the composite detergent mode M12, and the softener mode M13. The controller 200 may perform any one of the single detergent mode M11, the composite detergent mode M12, and the softener mode M13 based on a manipulation signal inputted by a user. The manipulation signal of the user may be inputted through the manipulation unit 50 or the communication terminal 300.

When the single detergent mode M11 and the composite detergent mode M12 are selected, the washing agent should be stored in both the first detergent container 1221 and the second detergent container 1222. The type of the stored washing agent may vary, but the washing agent should be stored.

However, when the softener mode M13 is selected, any one of the first detergent container 1221 and the second detergent container 1222 should store a softener.

Accordingly, if the detergent supply mode M1 is changed to the softener mode M13 after the single detergent mode M11 or the composite detergent mode M12 has been performed, any one of the first detergent container 1221 or the second detergent container 1222 may store the washing agent first and then store the softener, whereby the washing agent and the softener are mixed in the detergent container 122. Therefore, the residual detergent discharge step S600 may be performed to prevent the washing agent and the softener from being mixed.

That is, when the softener mode M13 is performed after the single detergent mode M11 or the composite detergent mode M12 has been performed, the controller 200 may determine that one of the first detergent container 1221 and the second detergent container 1222 corresponds to the detergent change scheduled state S100.

In addition, when the single detergent mode M11 or the composite detergent mode M12 is performed after the softener mode M13 has been performed, one of the first detergent container 1221 and the second detergent container 1222 may be determined to correspond to the detergent change scheduled state S100.

In the above-described manner, the controller 200 may determine that the first detergent container 1221 or the second detergent container 1222 corresponds to the detergent change scheduled state S100 in case of the detergent supply mode change S110.

In addition, the controller 200 may determine that the first detergent container 1221 or the second detergent container 1222 corresponds to the detergent change scheduled state S100 in case of the stored detergent change S120 for directly changing a detergent to be stored in the first detergent container 1221 or the second detergent container 1222.

The user may manipulate the manipulation unit 50 or the communication terminal 300 to input a signal for changing a detergent to be stored in the first detergent container 1221 or the second detergent container 1222. For example, when the user inputs a signal for changing a detergent stored in the first detergent container 1221, the controller 200 may determine that the first detergent container 1221 corresponds to the detergent change scheduled state $100.

In particular, when a signal for changing the detergent stored in the first detergent container 1221 or the second detergent container 1222 between the washing agent and the softener is inputted, the controller 200 may determine that the first detergent container 1221 or the second detergent container 1222, in which the detergent to be stored is changed between the washing agent and the softener, corresponds to the detergent change scheduled state S100.

Specifically, when the user inputs a signal for changing the detergent to be stored in the first detergent container 1221 from the washing agent to the softener, the controller 200 may determine that the first detergent container 1221 corresponds to the detergent change scheduled state S100. This may be applied likewise to a case of changing a detergent to be stored to a washing agent from a previously stored softener.

Referring back to FIG. 13, the controller 200 may perform a washing request step S200 of requesting to select whether to progress the residual detergent discharge step S600 through the notification unit 60 or the communication terminal 300 when it corresponds to the detergent change scheduled state S100.

Even in a situation in which the detergent change of the detergent container 122 is scheduled, the user may directly start a washing course of the laundry treating apparatus by skipping the residual detergent discharge step S600. When the residual detergent discharge step S600 is automatically performed despite the user's need, the usability of the user may be reduced. Accordingly, the controller 200 may perform the washing request step S200 to allow the user to select whether to progress the residual detergent discharge step S600.

When the user determines not to progress the washing according to the washing request step S200, a detergent input step S700 to be described later may be performed.

In addition, when the progress of the residual detergent discharge step S600 is determined in a washing progress determination step S300 of determining whether to progress the washing in response to the washing request step S200, the controller 200 may perform a water supply step S500. The water supply step S500 may include a water supply request step S510 of requesting a water supply and a water supply check step S520 of checking whether water is supplied by a user.

The controller 200 may perform the water supply request step S510 of requesting to put water into the first detergent container 1221 or the second detergent container 1222 through the notification unit 60 or the communication terminal 300.

Specifically, the user may select the progress of the residual detergent discharge step S600 by inputting a manipulation signal through the manipulation unit 50 or the communication terminal 300 in response to the washing request step S200. If it is determined to progress the residual detergent discharge step S600, the controller 200 may request to supply water to the detergent container 122 in the detergent change scheduled state S100.

The notification unit 60 or the communication terminal 300 may display a phrase such as "Please supply water to the first detergent container". In addition, the notification unit 60 corresponding to the "first detergent container" may request the user to supply water in a manner that the notification unit 60 repeatedly flickers at a predetermined time interval.

In the water supply request step S510, it is possible to request the user to supply water to the detergent container 122, in which the residual detergent discharge step S600 is to be performed, in various ways.

The water supply request step S510 may not necessarily be performed, and the controller 200 may directly operate the detergent pump 132 without the water supply request step S510 to perform the residual detergent discharge step S600.

Meanwhile, as described above, the laundry treating apparatus according to one embodiment of the present disclosure may further include a residual amount sensing unit 126. The residual amount sensing unit 126 may be disposed in each of the first detergent container 1221 and the second detergent container 1222 to sense water levels of the first detergent container 1221 and the second detergent container 1222.

The controller 200 may determine whether water is supplied to the first detergent container 1221 or the second detergent container 1222 according to the water supply request step S510 based on a measurement value of the residual amount sensing unit 126. A step of determining whether water is supplied in response to the water supply request step S510 may be defined as the water supply check step S520.

In the water supply check step S520, when it is recognized that water having a preset water level or more is supplied according to the residual amount sensing unit 126, the controller 200 may determine that water is supplied to the detergent container 122. When it is checked that the water is supplied to the detergent container 122 in the water supply check step S520, the controller 200 may operate the detergent pump 132 connected to the corresponding detergent container 122.

When the detergent pump 132 is operated, the detergent remaining in the detergent container 122 and the supplied water may be discharged together. As the supplied water is discharged together, washing may be performed up to the inside of the connected detergent hose 133. Until all of the input water is discharged, the controller 200 may operate the detergent pump 132. Yet, according to the criterion for controlling the operation of the detergent pump 132 by the controller 200, the operation of the detergent pump 132 may be stopped based on an operation time as well as a water level inside the detergent container 122.

Meanwhile, when the residual detergent discharge step S600 is completed, the controller 200 may request a user to newly supply a new detergent to the detergent container 122 from which the residual detergent is fully discharged. The controller 200 may include a detergent supply step S700 in which the controller 200 requests a supply to the first detergent container 1221 or the second detergent container 1222, for which the residual detergent discharge step S600 has been completed, through the notification unit 60 or the communication terminal 300 and determines whether the detergent is supplied.

That is, the detergent supply step S700 may include a detergent supply request step of requesting a user to supply a new detergent to the detergent container 122, in which the residual detergent discharge step S600 is completed, through the notification unit 60 or the communication terminal 300 and a detergent supply check step of checking whether the user supplies the new detergent to the detergent container 122 for which the detergent input is requested.

The detergent supply check step may be performed through the residual amount sensing unit 126 like the water supply check step S520. The controller 200 may check whether the detergent is supplied to the detergent container 122, in which the residual detergent discharge step S600 has been completed, using the measured value of the residual amount sensing unit 126.

Meanwhile, upon reviewing the operation scheme of the residual detergent discharge step S600, the controller 200 may control the detergent pump 132 to operate for a predetermined time in the residual detergent discharge step S600.

That is, in the residual detergent discharge step S600, the controller 200 may complete the residual detergent discharge step S600 in consideration of the operation time of the detergent pump 132 only irrespective of a water level of a liquid accommodated in the detergent container 122. When the detergent pump 132 is operated for a sufficient time, both the detergent remaining in the detergent container 122 and the detergent remaining in the detergent hose 133 may be sufficiently discharged.

The operation time of the detergent pump 132 may be variously set. It may be desirably determined based on the capacity of the detergent container 122. When the capacity of the detergent container 122 is large, the preset operation time of the detergent pump 132 may be increased.

Yet, in the residual detergent discharge step S600, the operation scheme of the detergent pump 132 is not simply dependent on the operation time. The controller 200 may perform the residual detergent discharge step S600 in consideration of both the measured value of the residual amount sensing unit 126 and the operation time of the detergent pump 132.

For example, even if the operation time of the detergent pump 132 exceeds a preset time, the detergent pump 132 may be continuously operated when the water level value measured by the residual amount sensing unit 126 is higher than a preset water level value. That is, the residual detergent discharge step S600 may be performed in consideration of both the measurement value of the residual amount sensing unit 126 and the operation time of the detergent pump 132.

Meanwhile, in the residual detergent discharge step S600, the controller may control the water supply unit 110 to supply water to the tub 30. As described above, the detergent discharged from the detergent container 122 by the detergent pump 132 may be moved to the water supply unit 110 by the detergent hose 133. In doing so, the controller 200 may control the water supply unit 110 to supply water together with the discharged detergent so that the discharged detergent may flow more smoothly.

That is, in the residual detergent discharge step S600, the controller 200 may control the water supply valve 140 to supply water to the water supply unit 110. Water discharged from the water supply unit 110 and a detergent may be supplied to the tub through the accommodation case 130.

Figure 16:
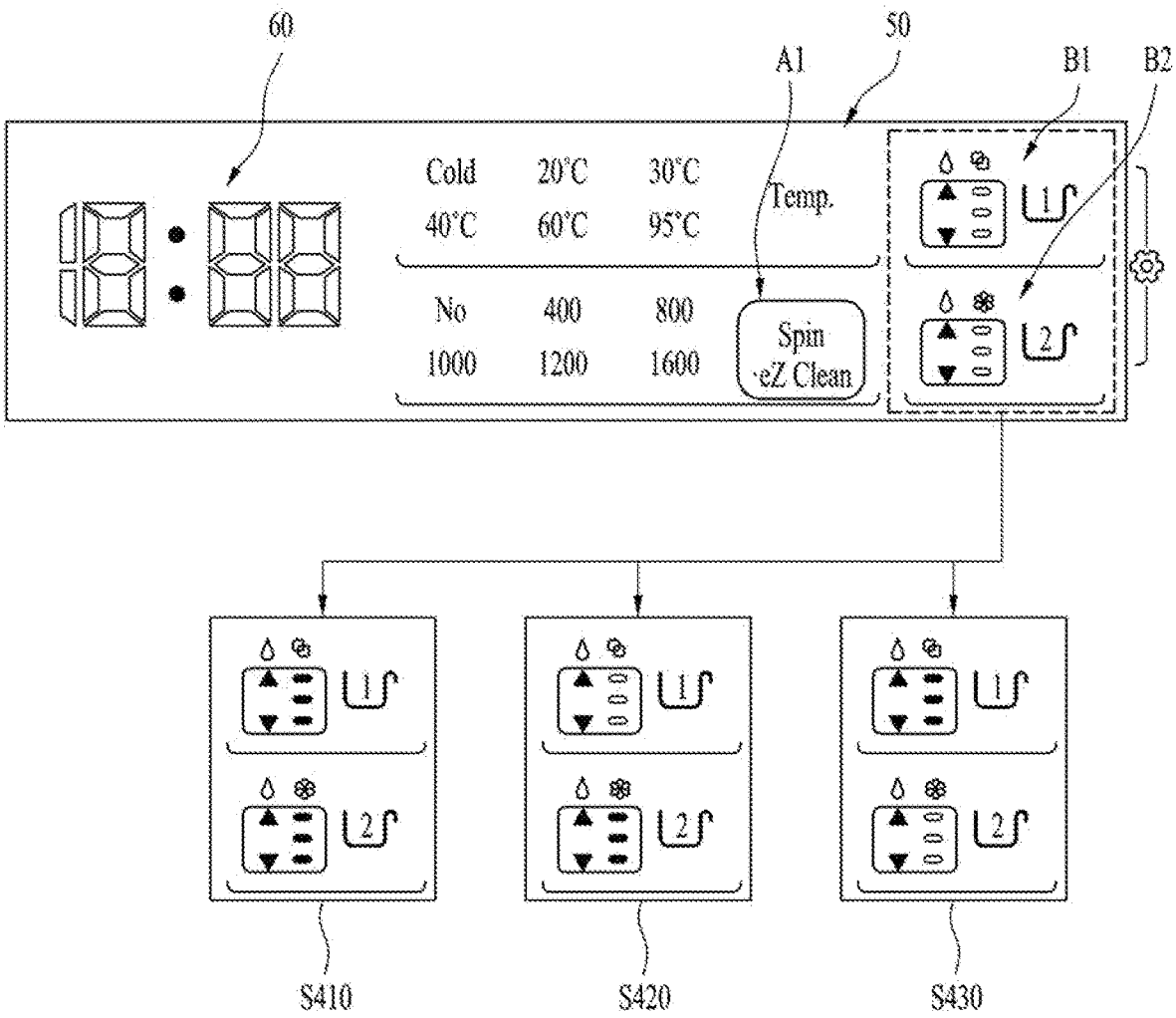
FIG. 16 is a diagram illustrating an example of an operation scheme of a manipulation unit according to one embodiment of the present disclosure.

FIG. 16 illustrates a process of selecting a detergent container to be washed through a manipulation unit.

Referring to FIG. 13 and FIG. 16 together, when the residual detergent discharge step S600 is determined to be progressed, the controller 200 may perform a detergent selection step S400 of selecting the detergent container 122 to progress the residual detergent discharge step S600 based on a user's manipulation signal inputted through the manipulation unit 50 or the communication terminal 300.

The user may select whether to perform the residual detergent discharge step S600 by manipulating a wash button A1. When the user presses the wash button A1 for a preset time or more, the controller 200 may determine that the residual detergent discharge step S600 is to be progressed.

When it is determined that the residual detergent discharge step S600 is to be progressed according to the manipulation of the wash button A1, the user may select a detergent container in which the residual detergent discharge step S600 is to be progressed by manipulating communication selection buttons B1 and B2.

When both the first button B1 and the second button B2 are manipulated, both the first detergent container 1221 and the second detergent container 1222 may be selected (S410). When the first button B1 is manipulated and the second button B2 is not manipulated, a first detergent container selection S420 may be performed. When the second button B2 is manipulated without manipulating the first button B1, a second detergent container selection S430 may be performed.

The controller 200 may control light corresponding to each detergent container to be turned on so that the user can check which detergent container has been selected. When all of the first and second detergent containers are selected (S410), the first button B1 and the second button B2 may be lighted. When the first detergent container is selected (S420), only the first button B1 may be lighted. Similarly, when the second detergent toy is selected (S430), only the second button B2 may be lighted.

An example of a specific manipulation may be performed as follows. When a user progresses the residual detergent discharge step S600, the wash button A1 may be manipulated to enter the detergent container selection step. When the user wants to change a detergent stored in the first detergent container 1221 from a washing detergent to a softener, the first button B1 may be manipulated. When the user manipulates the first button B1 to complete the first detergent container selection S410, the first button B1 is lighted so that the user may recognize that the first detergent container 1221 is selected. Thereafter, the controller 200 may control the first detergent pump 1321 connected to the first detergent container 1221 to perform the residual detergent discharge step S600 of the first detergent container 1221.

The above-described manipulation process may be performed during the detergent supply mode change S110 or the stored detergent change S120. When the detergent supply mode is changed from the single detergent mode to the softener mode, the user may change the detergent stored in one of the first detergent container 1221 and the second detergent container 1222 from a washing detergent to a softener. In this case, a detergent container in which a stored detergent is changed may be selected to progress the residual detergent discharge step S600 with respect to the corresponding detergent container.

Although the present disclosure has been illustrated and described in connection with a specific embodiment, it would be obvious to those skilled in the art, to which the present disclosure pertains, that the present disclosure can be variously modified and changed without departing from the technical spirit of the present disclosure provided by the claims below.

What is claimed is:

1. An apparatus for treating laundry, comprising;

a cabinet;

a tub disposed in the cabinet and configured to receive water therein;

a drum rotatably disposed in the tub and configured to receive the laundry therein;

a detergent supplier connected to the tub, the detergent supplier comprising (i) a first detergent container and a second detergent container that are configured to store a detergent and (ii) at least one detergent pump connected to the first detergent container or the second detergent container and configured to supply the detergent to the tub; and a controller configured to:

determine whether the first detergent container or the second detergent container is in a detergent change scheduled state for changing the detergent to a different type of detergent, and discharge, by driving the at least one detergent pump, a residual detergent from the first detergent container or the second detergent container that is in the detergent change scheduled state.

2. The apparatus of claim 1, further comprising a manipulator disposed at the cabinet, wherein the controller is configured to:

receive a manipulation signal inputted by a user through the manipulator or through a communication terminal carried by the user; and determine the detergent change scheduled state based on receiving the manipulation signal through the manipulator or the communication terminal.

3. The apparatus of claim 1, wherein the at least one detergent pump comprises:

a first detergent pump connected to the first detergent container; and a second detergent pump connected to the second detergent container, and wherein the controller is configured to independently control the first detergent pump and the second detergent pump to discharge the residual detergent from the first detergent container and the second detergent container, respectively.

4. The apparatus of claim 1, wherein each of the first detergent container and the second detergent container is configured to store at least one of (i) a washing agent for removing contaminants from the laundry or (ii) a softener for providing flexibility to the laundry and wherein the controller is configured to determine the detergent change scheduled state based on the detergent stored in the first detergent container or the second detergent container being scheduled to be changed between the washing agent and the softener.

5. The apparatus of claim 4, wherein the controller is configured to control the detergent supplier to selectively perform one of (i) a single detergent mode for supplying the washing agent from one of the first detergent container or the second detergent container to the tub, (ii) a composite detergent mode for supplying the washing agent from each of the first detergent container and the second detergent container to the tub, and (iii) a softener mode for supplying the washing agent from one of the first detergent container or the second detergent container to the tub and supplying the softener from the other one of the first detergent container and the second detergent container to the tub.

6. The apparatus of claim 5, further comprising a manipulator disposed at the cabinet, wherein the controller is configured to:

receive a manipulation signal inputted by a user through the manipulator or through a communication terminal carried by the user; and perform any one of the single detergent mode, the composite detergent mode, or the softener mode based on receiving the manipulation signal through the manipulator or the communication terminal.

7. The apparatus of claim 5, wherein the controller is configured to determine the detergent change scheduled state (i) based on performing the softener mode after performing the single detergent mode or the composite detergent mode or (ii) based on performing the single detergent mode or the composite detergent mode after performing the softener mode.

8. The apparatus of claim 4, further comprising a manipulator disposed at the cabinet, wherein the controller is configured to:

receive a manipulation signal inputted by a user through the manipulator or through a communication terminal carried by the user; and determine the detergent change scheduled state based on receiving the manipulation signal for changing the detergent stored in each of the first detergent container and the second detergent container (i) from the washing agent to the softener or (ii) from the softener to the washing agent.

9. The apparatus according to claim 1, further comprising a notification interface disposed at the cabinet, wherein the controller is configured to, based on determining that the first detergent container or the second detergent container is in the detergent change scheduled state, request a user, through the notification interface or a communication terminal carried by the user, to select whether to progress a residual detergent discharge operation for discharging the detergent from the first detergent container or the second detergent container.

10. The apparatus of claim 9, wherein the controller is configured to, based on the user selecting to progress the residual detergent discharge operation, provide a request to the user to supply water to the first detergent container or the second detergent container through the notification interface or the communication terminal.

11. The apparatus of claim 10, further comprising a residual amount sensor configured to detect a water level in the first detergent container or the second detergent container, wherein the controller is configured to, in response to the request to supply the water, determine whether the water is supplied to the first detergent container or the second detergent container based on a measurement value of the residual amount sensor.

12. The apparatus of claim 11, wherein the controller is configured to perform the residual detergent discharge operation based on determining that the water is supplied to the first detergent container or the second detergent container in response to the request to supply the water.

13. The apparatus of claim 1, further comprising a notification interface disposed at the cabinet, wherein the controller is configured to, based on completing a residual detergent discharge operation for discharging the detergent from the first detergent container or the second detergent container, request a user, through the notification interface or a communication terminal carried by the user, to supply the detergent to the first detergent container or the second detergent container that has completed the residual detergent discharge operation.

14. The apparatus of claim 1, wherein the controller is configured to control the at least one detergent pump to operate for a preset time in a residual detergent discharge operation for discharging the detergent from the first detergent container or the second detergent container.

15. The apparatus of claim 1, wherein the detergent supplier comprises:

a detergent storage configured to be inserted into and withdrawn from the cabinet, the detergent storage being configured to accommodate the first detergent container and the second detergent container therein; and a water supply that is connected to an external water supply source and configured to receive water and that is connected to the at least one detergent pump and configured to receive the detergent discharged from the first detergent container or the second detergent container, the water supply being configured to supply the detergent or the water to the tub, and wherein the controller is configured to control the water supply to supply the water to the tub in a residual detergent discharge operation for discharging the detergent from the first detergent container or the second detergent container.

16. The apparatus of claim 14, further comprising a residual amount sensor configured to detect a water level in the first detergent container or the second detergent container, wherein the controller is configured to:

determine whether the water level is greater than a preset water level after operating the at least one detergent pump for the preset time; and based on determining that the water level is greater than the preset water level, continue to operate the at least one detergent pump after operating the at least one detergent pump for the preset time.

17. The apparatus of claim 1, wherein the controller configured to:

determine whether each of the first detergent container and the second detergent container is in the detergent change scheduled state; and discharge the residual detergent from each of the first detergent container and the second detergent container.

18. The apparatus of claim 2, wherein the manipulator comprises at least one of a touch panel, a button, a dial, or a microphone.

19. The apparatus of claim 2, further comprising a transceiver configured to connect the controller to the communication terminal.

20. The apparatus of claim 13, wherein the notification interface comprises at least one of a speaker configured to provide auditory information to the user, a display configured to provide visual information to the user, or a light emitting indicator.

* * * * *